US008824905B2

(12) United States Patent
Kitagawa

(10) Patent No.: US 8,824,905 B2
(45) Date of Patent: Sep. 2, 2014

(54) STORAGE CONTAINER FOR DEVELOPER AND IMAGE FORMING APPARATUS

(75) Inventor: Yusuke Kitagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 762 days.

(21) Appl. No.: 13/091,727

(22) Filed: Apr. 21, 2011

(65) Prior Publication Data

US 2012/0121279 A1 May 17, 2012

(30) Foreign Application Priority Data

Nov. 12, 2010 (JP) ..... 2010-253392

(51) Int. Cl.
*G03G 21/12* (2006.01)
*G03G 15/08* (2006.01)

(52) U.S. Cl.
CPC ..... *G03G 15/0862* (2013.01); *G03G 15/0831* (2013.01)
USPC ..... 399/35; 399/360

(58) Field of Classification Search
USPC ..... 399/35, 358, 360
See application file for complete search history.

(56) References Cited

U.S. PATENT DOCUMENTS

| | | | | |
|---|---|---|---|---|
| 5,619,312 | A * | 4/1997 | Hatano et al. | 399/61 |
| 5,634,172 | A * | 5/1997 | Manabe | 399/35 |
| 7,120,366 | B2 * | 10/2006 | Onodera et al. | 399/35 |
| 8,204,390 | B2 * | 6/2012 | Kobayashi | 399/9 |
| 2005/0169649 | A1 * | 8/2005 | Onodera et al. | 399/35 |
| 2007/0196147 | A1 * | 8/2007 | Nada et al. | 399/358 |
| 2011/0091227 | A1 * | 4/2011 | Tomita et al. | 399/35 |
| 2012/0121278 | A1 * | 5/2012 | Kitagawa | 399/35 |
| 2013/0129366 | A1 * | 5/2013 | Furukawa | 399/34 |

FOREIGN PATENT DOCUMENTS

| | | | |
|---|---|---|---|
| JP | 63-23183 | A | 1/1988 |
| JP | 2006-18329 | A | 1/2006 |
| JP | 2008-129173 | A | 6/2008 |

OTHER PUBLICATIONS

Office Action dated Apr. 30, 2014 issued by the Japanese Patent Office in counterpart Japanese Patent Application No. 2010-253392.

* cited by examiner

*Primary Examiner* — G. M. Hyder
(74) *Attorney, Agent, or Firm* — Sughrue Mion, PLLC

(57) ABSTRACT

A storage container for a developer, includes: a first storage unit; a second storage unit; a detection member; a full-state determining unit; and a conveyance member as defined herein, and one end side of the conveyance member is supported on other end side of the first storage unit in a cantilever state, and other end side of the conveyance member is disposed to have a gap with respect to a wall of one end side of the second storage unit.

8 Claims, 15 Drawing Sheets

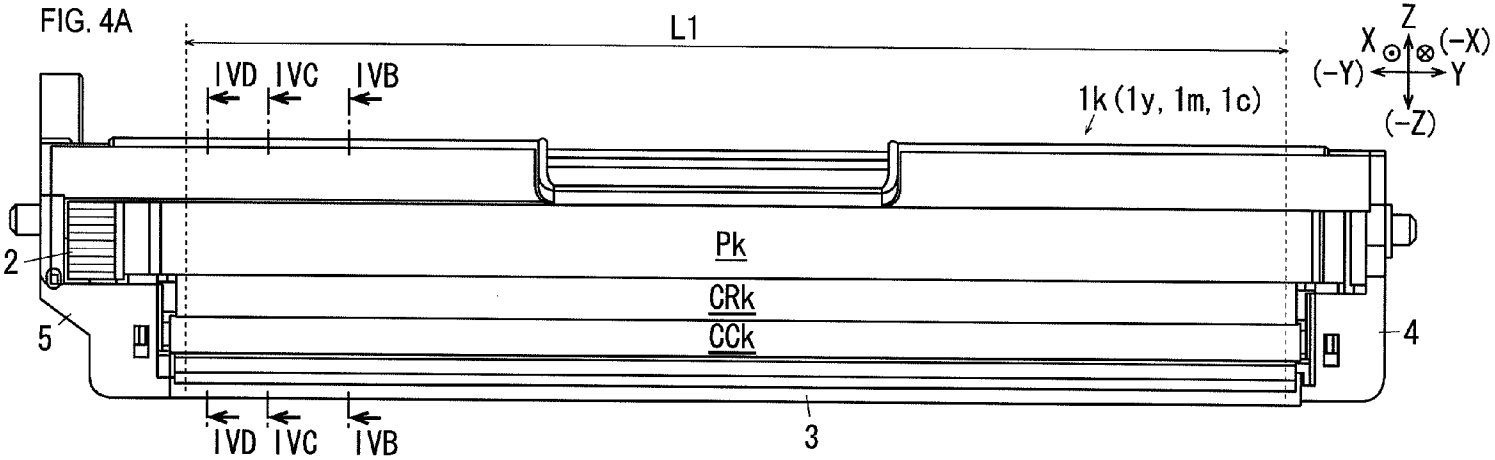
FIG. 4A
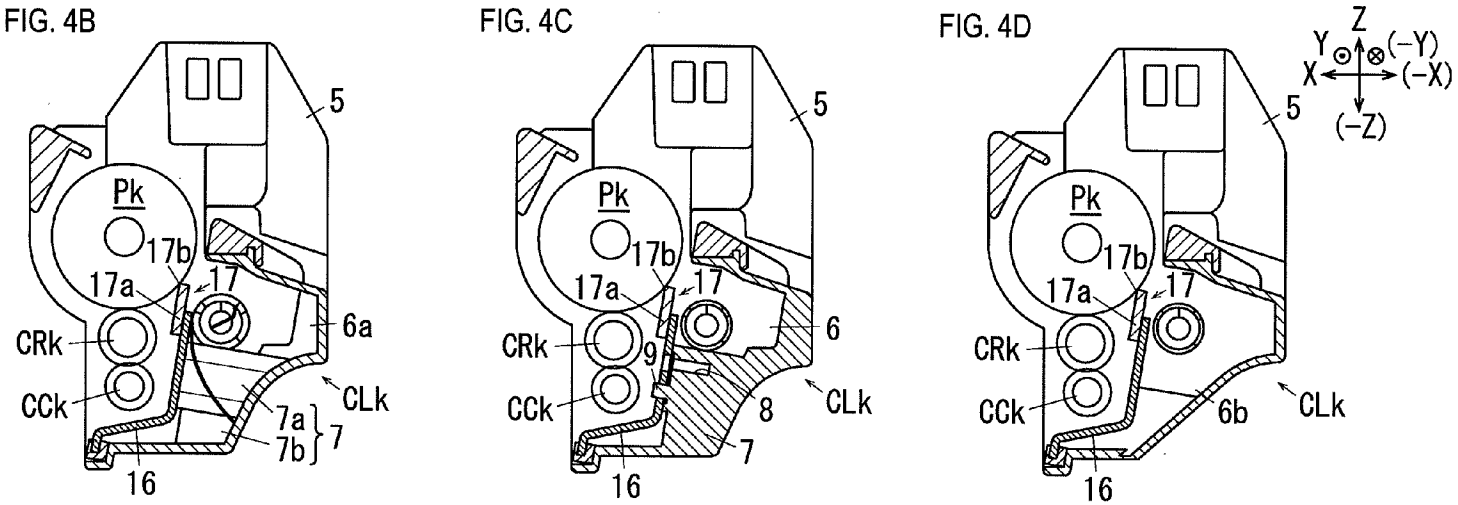
FIG. 4B
FIG. 4C
FIG. 4D 22
22a
26
27
27a
27b
27c
27d
X
Y
Z
(−X)
(−Y)
(−Z)

STORAGE CONTAINER FOR DEVELOPER AND IMAGE FORMING APPARATUS

CROSS-REFERENCE TO RELATED APPLICATIONS

This application is based on and claims priority under 35 USC 119 from Japanese Patent Application No. 2010-253392 filed on Nov. 12, 2010.

BACKGROUND

Technical Field

The present invention relates to a storage container for a developer, and an image forming apparatus.

SUMMARY

According to an aspect of the invention, there is provided a storage container for a developer, including: a first storage unit in which a collected developer is stored; a second storage unit which is disposed at an end of one end side of the first storage unit, in which the developer conveyed from the first storage unit is stored; a detection member which detects the developer stored in the second storage unit; a full-state determining unit which determines whether the first storage unit is a full state or not (whether the first storage unit is filled with the developer or not), based on a detected result of the detection member; and a conveyance member which is disposed in the first storage unit, and is rotated to convey the developer stored in the first storage unit to the second storage unit, wherein one end side of the conveyance member is supported on other end side of the first storage unit in a cantilever state, and the other end side of the conveyance member is disposed to have a gap with respect to a wall of one end side of the second storage unit.

BRIEF DESCRIPTION OF THE DRAWINGS

Exemplary embodiments of the present invention will be described in detail based on the following figures, wherein:

FIGS. 4A. 4B, 4C and 4D are overall explanatory views of a photoreceptor unit according to the first example, in which FIG. 4A is a view of the photoreceptor unit as is seen from the front, FIG. 4B is a cross-sectional view taken along the line IVB-IVB in FIG. 4A, FIG. 4C is a cross-sectional view taken along the line IVC-IVC in FIG. 4A, and FIG. 4D is a cross-sectional view taken along the line IVD-IVD in FIG. 4A;

FIG. 6A is a perspective view of the same cross-section as FIG. 4B, FIG. 6B is a perspective view of the same cross-section as FIG. 4C, and FIG. 6C is a perspective view of the same cross-section as FIG. 4D;

FIGS. 7A and 7B are perspective views illustrating an image retainer unit as seen from below and the left at an angle, in which FIG. 7A is an explanatory view illustrating a major part of a detection storage unit, and FIG. 7B is an explanatory view illustrating a major part of the detection storage unit in a state where a cover member is removed from the detection storage unit;

FIGS. 8A, 8B, 8C, 8D and 8E are explanatory views illustrating a detection storage unit according to the first example, in which FIG. 8A is a side view of the detection storage unit seen from the front, FIG. 8B is a side view of the detection storage unit seen from the rear, FIG. 8C is a perspective view of the detection storage unit seen from below and the right at an angle, FIG. 8D is a perspective view of the detection storage unit downwardly seen from above and the right at an angle, and FIG. 8E is a perspective view of the detection storage unit seen from below and behind at an angle;

FIGS. 9A, 9B and 9C are explanatory views illustrating a detection target portion according to the first example, in which FIG. 9A is an explanatory view illustrating the state in which a developer starts to flow in the detection storage unit, FIG. 9B is an explanatory view illustrating the state in which the developer flows to the inside of the detection target portion, and FIG. 9C is an explanatory view of a detection member;

FIGS. 10A and 10B are explanatory views illustrating a conveyance member according to the first example, in which FIG. 10A is a perspective view, and FIG. 10B is a side view;

FIGS. 11A, 11B and 11C are explanatory views illustrating a shaft portion of a conveyance member according to the first example, in which FIG. 11A is a perspective view, FIG. 11B is an enlarged explanatory view of the portion indicated by the arrow XIB in FIG. 11A, and FIG. 11C is a view seen from a direction of the arrow XIC in FIG. 11B;

FIGS. 12A and 12B are explanatory views illustrating the relationship between a slit and a protruding strip in a leveling member, in which FIG. 12A is a perspective view of a major part, and FIG. 12B is a cross-sectional view taken along the line XIIB-XIIB in FIG. 12A;

FIGS. 13A, 13B and 13C are explanatory views corresponding to FIG. 5 illustrating the amount of developer collected in a cleaner according to the first example, in which FIG. 13A is an explanatory view illustrating the state in which the amount of the developer collected is small, FIG. 13B is an explanatory view illustrating the state in which the developer starts to flow into a downstream chamber, and FIG. 13C is an explanatory view illustrating the state in which the developer starts to flow in a buffer chamber from the downstream chamber;

FIGS. 14A and 14B are explanatory views corresponding to FIG. 4D illustrating the amount of developer collected in a cleaner according to the first example, in which FIG. 14A is an explanatory view corresponding to FIG. 13B, and FIG. 14B is an explanatory view corresponding to FIG. 13C; and FIGS. 15A, 15B, 15C and 15D are explanatory views illustrating a state of the downstream end portion of a conveyance auger according to the first example, in which FIG. 15A is an explanatory view illustrating a state in which an outer peripheral surface of a spiral conveyance portion corresponding to FIG. 5 comes in contact with an inner peripheral surface of a third storage section, FIG. 15B is a cross-sectional view taken along the line XVB-XVB in FIG. 15A, FIG. 15C is an explanatory view illustrating a state in which the spiral conveyance portion is rotated from the state shown in FIG. 15A and then a shaft portion is slanted, and FIG. 15D is a cross-sectional view taken along the line XVD-XVD in FIG. 15C.

DESCRIPTION OF REFERENCE NUMERALS AND SIGNS

6: first storage unit

27: third storage unit

Figure 1:
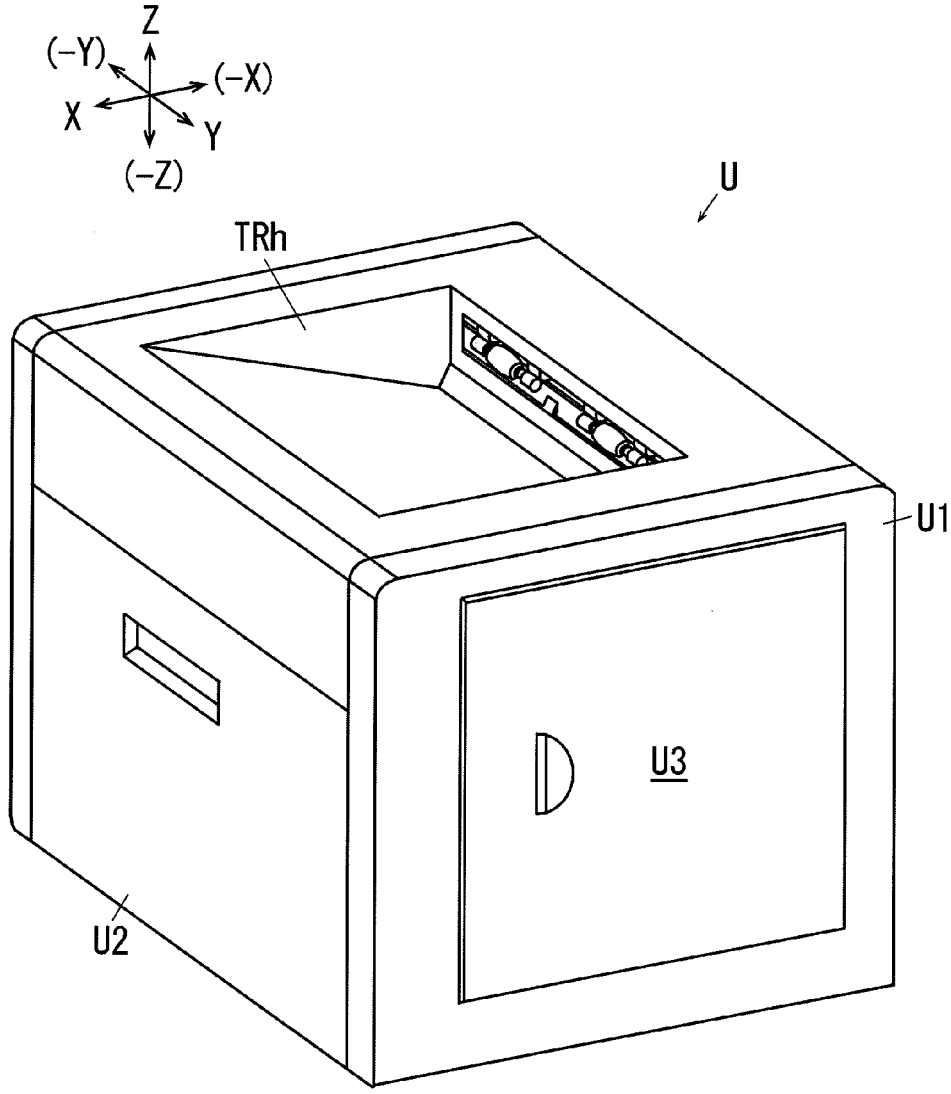
FIG. 1 is an overall perspective view of a printer according to a first example of the present invention.

27*d*: outlet portion
28*a*: second storage unit
29: detection member
31: conveyance member
44: conveyance portion
C1: full-state determining unit
CLy, CLm, CLc, CLk: storage container for developer
Gy, Gm, Gc, Gk: developing unit
La, Lb: length
Py, Pm, Pc, Pk: image retainer
S: medium
T1*y* to T1*k*+T2+B: transfer unit
U: image forming apparatus

DETAILED DESCRIPTION

Although specific examples of an exemplary embodiment for carrying out the present invention will be described below with reference to the drawings, the invention is not limited to the following examples.

In order to facilitate understanding of the following description, in the drawings, the front/rear direction is indicated as the X-axis direction, the left/right direction is indicated as the Y-axis direction and the up/down direction is indicated as the Z-axis direction, and directions or sides designated by the arrows X, −X, Y, −Y, Z and −Z are indicated as the front direction, the rear direction, the right direction, the left direction, the upper direction and the lower direction, or the front side, the rear side, the right side, the left side, the upper side and the lower side respectively.

In the drawings, each arrow with "•" written inside "O" means an arrow directed from the back side of the sheet to the front side thereof and each arrow with "x" written inside "O" means an arrow directed from the front side of the sheet to the back side thereof.

In the following description using the drawings, any other member than members required for description is appropriately omitted from the drawings for the purpose of facilitating understanding.

Example 1

FIG. 1 is an overall perspective view of a printer according to a first example of the present invention.

In FIG. 1, a printer U as an image forming apparatus according to the first example of the present invention includes an image forming apparatus body U1. A front cover U2 is supported on the front surface of the image forming apparatus body U1 so as to open and close with a lower end of the front cover U2 as the center. The front cover U2 is an example of an opening/closing member, which is opened and closed for supplying new media. A side cover U3 is supported on the right surface of the image forming apparatus body U1 so as to open and close around a rear end of the side cover. If the side cover U3 is opened, exchanging operation for a toner cartridge (not illustrated), which is an example of a storage container storing new developer used to form an image, can be performed. A discharge tray TRh which is an example of a paper discharge portion of a medium is provided on an upper surface of the image forming apparatus body U1.

Figure 2:
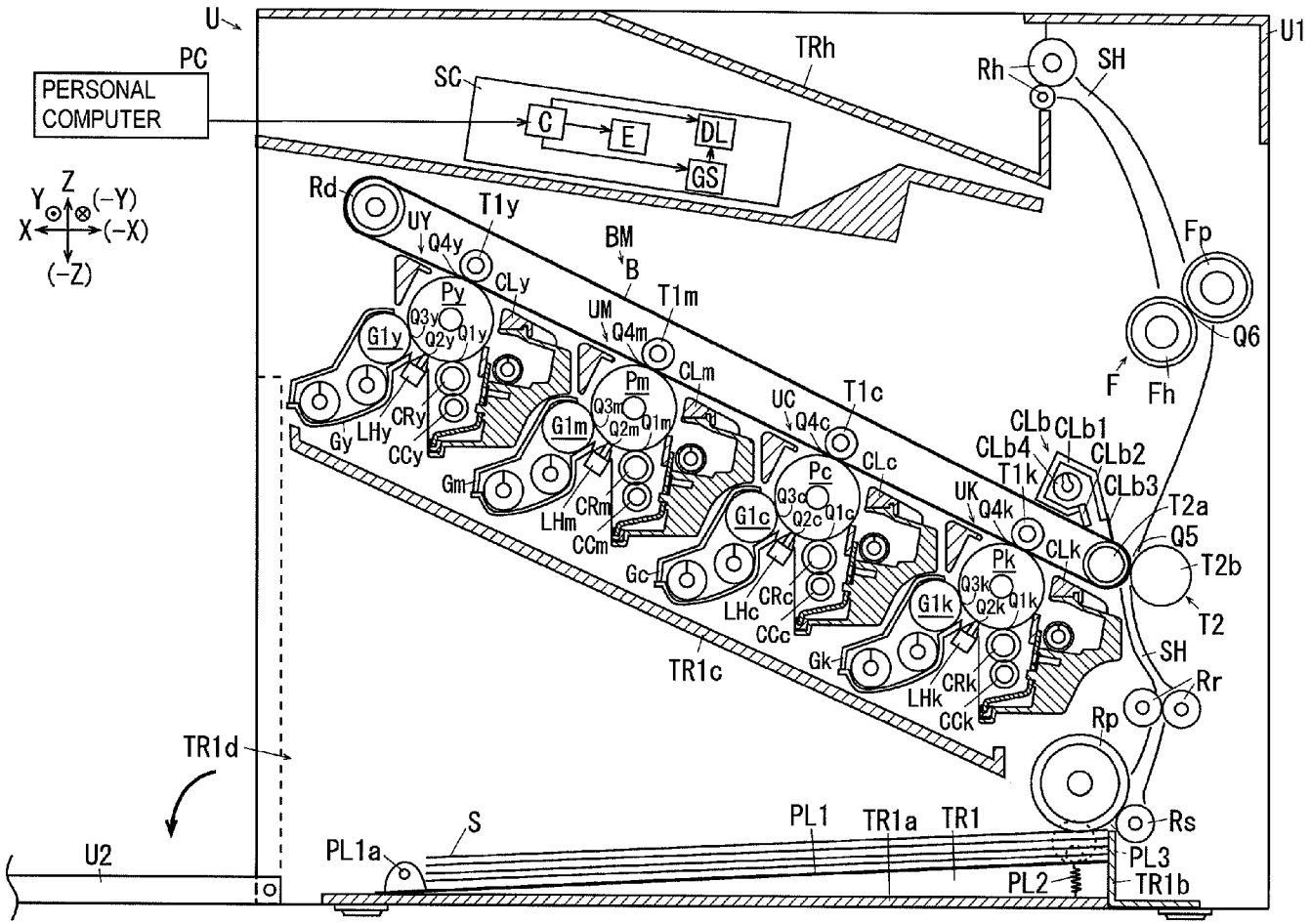
FIG. 2 is an overall explanatory view illustrating the image forming apparatus according to the first example of the present invention.

FIG. 2 is an overall explanatory view illustrating the image forming apparatus according to the first example of the present invention.

In FIGS. 1 and 2, the front cover U2 is supported so as to be movable between an open position indicated by the solid line in FIG. 2 and a closed position indicated by a broken line in FIGS. 1 and 2. When the front cover U2 is in the open position, a sheet as an example of a medium can be inserted.

In FIG. 2, in the upper portion of the printer U, a control board SC where various control circuits, storage media, or the like are arranged is disposed under the discharge tray TRh. The control board SC is provided with a control unit C for performing various controls on the printer U, an image processing unit GS, a latent image forming unit driving unit DL, a power supply circuit E which is an example of a power supply device, and the like. The operations of the image processing unit GS, the latent image forming unit driving circuit DL and the power supply circuit E are controlled by the control portion C. The power supply circuit E applies voltages to charging rollers CRy to CRk which are an example of a charger, developing rollers G1*y* to G1*k* which are an example of a developer retainer, transfer rollers T1*y* to T1*k* which are an example of a transfer device, and the like, which will be described later.

The image processing portion GS converts print information, which is input from a personal computer PC or the like as an example of an image information transmitting apparatus disposed externally to the printer U and electrically connected thereto, into image information for forming latent images corresponding to four colors of image, being yellow, magenta, cyan and black, that is, Y, M, C and K. The image processing portion GS outputs the converted image information to the latent image forming unit driving circuit DL at given times.

When an original image is a an image with one color, or a so-called monochrome image, black image information only is input to the latent image forming unit driving circuit DL.

The latent image forming unit driving circuit DL has drive circuits (not illustrated) of yellow Y, magenta M, cyan C and black K to output signals corresponding to the input image information to LED heads LHy, LHm, LHc and LHk, which is an example of a latent image forming unit disposed for each color, at given times respectively.

Figure 3:
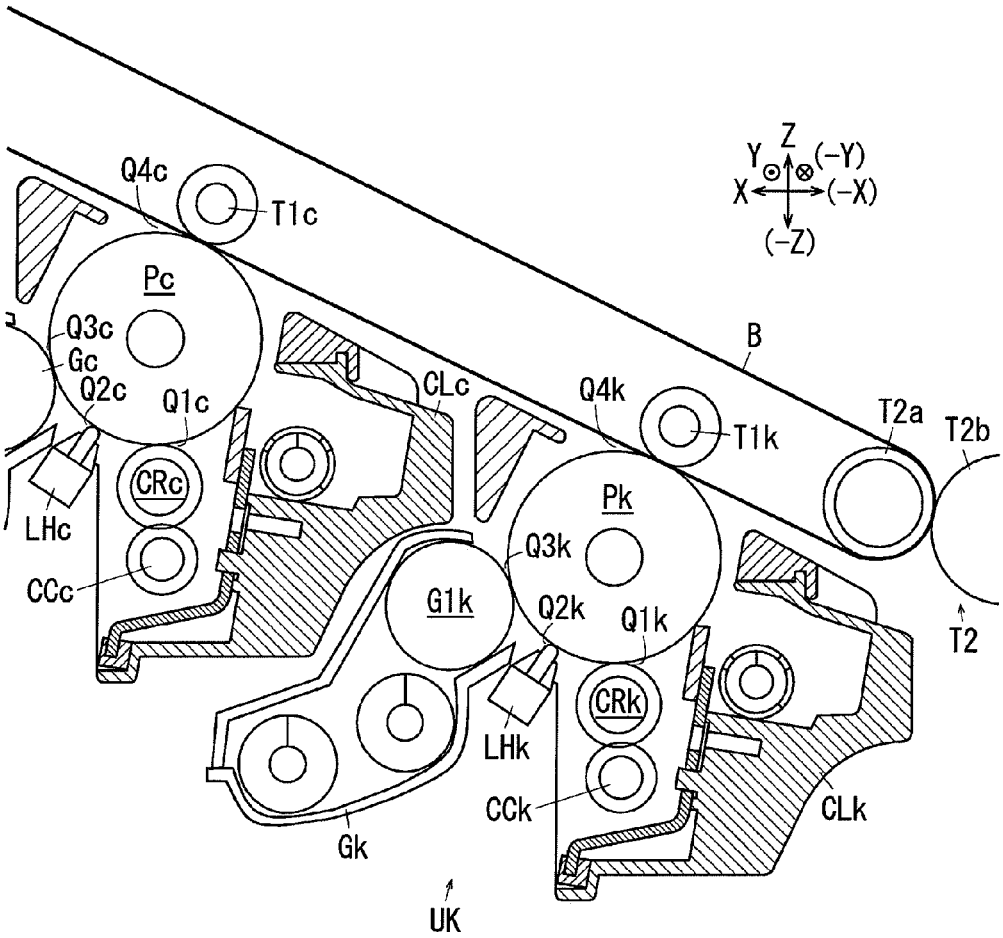
FIG. 3 is an explanatory view illustrating a major part of a visible image forming unit for black according to the first example.

FIG. 3 is an explanatory view illustrating a major part of a visible image forming unit for black according to the first example.

In FIG. 2, visible image forming units UY, UM, UC and UK for forming toner images as examples of visible images of the respective colors, yellow, magenta, cyan and black, are disposed at the lower portion of the image forming apparatus body U1. In FIGS. 2 and 3, the visible image forming unit UK for black, that is, the color K has a photoreceptor Pk which is an example of an image retainer and is driven to rotate. The charging roller CRk which is an example of a charger for charging the surface of the photoreceptor Pk, the LED head LHk which is an example of a latent image forming unit for forming an electrostatic latent image on the surface of the photoreceptor Pk, a developing unit Gk for developing the electrostatic latent image on the surface of the photoreceptor Pk into a visible image, a photoreceptor cleaner CLk which is an example of an image retainer cleaner for removing a developer remaining on the surface of the photoreceptor Pk, and the like are disposed around the photoreceptor Pk.

In the visible image forming unit UK according to the first example, the charging roller CRk is interposed between the photoreceptor Pk and a charging roller cleaner CCk which is an example of charging cleaner for cleaning the surface of the charging roller CRk. The charging roller cleaner CCk comes into contact with the charging roller CRk and is disposed at the opposite side of the photoreceptor Pk.

The visible image forming units UY, UM and UC for other colors are configured in the same manner as the black visible image forming unit UK.

The surfaces of the photoreceptors Py to Pk are charged in charging areas Q1*y*, Q1*m*, Q1*c* and Q1*k* which are opposed to the charging rollers CRy to CRk by the charging rollers CRy to CRk, respectively. Then, latent images are written on the surfaces by the LED heads LHy to LHk in latent image forming areas Q2*y*, Q2*m*, Q2*c* and Q2*k* respectively. The written electrostatic latent images are developed into toner images in developing areas Q3*y*, Q3*m*, Q3*c* and Q3*k* opposed to the developing units Gy to Gk, respectively, as one example of a visible image. The developed toner images are conveyed to primary transfer areas Q4*y*, Q4*m*, Q4*c* and Q4*k* contacting with an intermediate transfer belt B which is an example of an intermediate transfer unit which is an example of an image retainer. In the primary transfer areas Q4*y*, Q4*m*, Q4*c* and Q4*k*, primary transfer voltages, the polarities of which are reverse to the charged polarity of the toners, are applied to primary transfer rollers T1*y*, T1*m*, T1*c* and T1*k* at time periods set in advance respectively by the power supply circuit E controlled by the control unit C. Each of the primary transfer rollers T1*y*, T1*m*, T1*c*, T1*k* is an example of a primary transfer unit disposed on a rear side of the intermediate transfer belt B.

The toner images on each of the photoreceptors Py to Pk are primarily transferred onto the intermediate transfer belt B by the primary transfer rollers T1*y*, T1*m*, T1*c* and T1*k* respectively.

After the primary transfer, residual or attached materials, such as untransferred toners or corona products, on the surfaces of the photoreceptors Py, Pm, Pc and Pk are cleaned up by the photoreceptor cleaners CLy, CLm, CLc and CLk respectively. The cleaned surfaces of the photoreceptors Py, Pm, Pc and Pk are charged again by the charging rollers CRy, CRm, CRc and CRk respectively. Residual materials or the like that cannot be removed by the photoreceptor cleaners CLy to CLk but adhere to the charging rollers Cry to CRk are cleaned up by charger cleaners CCy, CCm, CCc and CCk disposed in contact with the charging rollers CRy to CRk, respectively. Each of the charger cleaners CCy, CCm, CCc, and CCk is an example of a charger cleaning member.

In FIG. 2, a belt module BM which is an example of an intermediate transfer unit is disposed above the photoreceptors Py to Pk. The belt module BM includes the intermediate transfer belt B which is an example of an object and an example of an intermediate transfer unit. The intermediate transfer belt B is rotatably supported by an intermediate transfer supporting system which includes a belt driving roller Rd as an example of a driving member, a backup roller T2*a* as an example of a driven member and an example of a secondary transfer opposed member, and the primary transfer rollers T1*y*, T1*m*, T1*c* and T1*k* disposed in opposition to the photoreceptors Py to Pk respectively.

A belt cleaner CLb which is an example of an intermediate transfer unit cleaner is disposed above the rear portion of the intermediate transfer belt B. The belt cleaner CLb has a cleaning vessel CLb1, a belt cleaning blade CLb2, a film CLb3 and a conveyance auger CLb4. The belt cleaning blade CLb2 is an example of a cleaning member, which is supported on the cleaning vessel CLb1 and brought into contact with the intermediate transfer belt B to remove and clean residual materials remaining on the surface of the intermediate transfer belt B. The film CLb3 is an example of a leakage prevention member, which prevents the residual materials removed by the belt cleaning blade CLb2 from flying or and leaking out. The conveyance auger CLb4 is an example of a residual material conveyance member disposed in the cleaning vessel CLb1 to convey and discharge the removed residual materials. The cleaning vessel CLb1 according to the first example is disposed in a position above the black photoreceptor cleaner CLk.

The belt module BM according to the first example includes the intermediate transfer belt B, the belt driving roller Rd, the backup roller T2*a*, and the primary transfer rollers T1*y* to T1*k*, and the belt cleaner CLb. In this instance, the belt module BM according to the first example is detachably configured such that it can be detached from the above, when the top cover (not illustrated) is opened from the upper portion of the image forming apparatus body U1.

A secondary transfer roller T2*b* which is an example of a secondary transfer member is disposed opposite to the surface of the intermediate transfer belt B which is in contact with the backup roller T2*a*. A secondary transfer unit T2 according to the first example is constituted by the backup roller T2*a* and the secondary transfer roller T2*b*. A secondary transfer area Q5 is formed by the area where the secondary transfer roller T2*b* and the intermediate transfer belt B are opposed to each other.

The monochrome or multi-color toner images transferred to overlap one another in turn on the intermediate transfer belt B in the primary transfer areas Q4*y*, Q4*m*, Q4*c* and Q4*k* by the primary transfer rollers T1*y*, T1*m*, T1*c* and T1*k* respectively are conveyed to the secondary transfer area Q5.

A transfer unit T1*y* to T1*k*+T2+B according to the first example is constituted by the primary transfer rollers T1*y* to T1*k*, the intermediate transfer belt B and the secondary transfer unit T2.

As shown in FIG. 2, the intermediate transfer belt B according to the first example is disposed so that the primary transfer areas Q4*y* to Q4*k* descend rearward with respect to the horizontal plane. Correspondingly thereto, the visible image forming units UY to UK are also disposed so that one is offset from one another in the direction of gravity as it goes in the belt rotation direction.

Under the visible image forming units UY to UK, a paper feed tray TR1 is provided as an example of a medium storage unit. The paper feed tray TR1 has a bottom wall TR1*a*, a rear end wall TR1*b* and an upper wall TR1*c*. The bottom wall TR1*a* is an example of a lower wall. The rear end wall TR1*b* extends upward from the rear end of the bottom wall TR1*a*. The upper wall TR1*c* is disposed above the bottom wall TR1*a* and in opposition thereto. A supply port TR1*d* for supplying new recording sheets S is formed in the front end portion of the paper feed tray TR1. The front end portion of the upper wall TR1*c* is formed to ascend upwardly toward the outside, that is, the front side, of the supply port TR1*d*. Accordingly, the distance between the upper wall TR1*c* and the bottom wall TR1*a* in the supply port TR1*d* becomes larger toward the front side. Thus, the supply port TR1*d* is formed to be wider toward the front side.

A lifting plate PL1 which is a media loading portion is disposed on the bottom wall TR1*a*. The lifting plate PL1 is supported rotatably around a rotation center PL1*a* and loaded with the recording sheets S which is an example of a medium. A lifting spring PL2 which is an example of a biasing member for biasing the rear end portion of the lifting plate PL1 upward is disposed on the rear end portion of the lifting plate PL1. When image formation is not performed, the lifting plate PL1 is maintained in a descended position where the lifting plate PL1 is kept in parallel with the bottom wall TR1*a* by depressing members PL3 formed in the shape of an eccentric cam. The depressing members PL3 are disposed at left and right end portions of the lifting plate PL1. During image formation, the depressing members PL3 are rotated, and then the lifting plate PL1 is lifted by the lifting spring PL2, so that the lifting plate PL1 is supported movably between the descended position and an ascended position where the printing sheet S is lifted as shown in FIGS. 4A. 4B, 4C and 4D.

Accordingly, when the front cover U2 is opened, the supply port TR1*d* is opened to the outside. A new sheaf of recording sheets S can be inserted to abut against the rear end wall TR1*b* so as to be loaded and received on the lifting plate PL1 in the descended position.

A paper feed roller Rp which is an example of a feeding-out member is disposed at the rear of the upper wall TR1*c*. The paper feed roller Rp is disposed in a position where the uppermost recording sheet S of the sheaf of loaded recording sheets S can be pushed against the paper feed roller Rp by the spring force of the lifting spring PL2 in the state where the lifting plate PL1 has moved to the ascended position. A retard roller Rs which is an example of a disposal member is disposed above the rear end wall TR1*b*.

The recording sheets S loaded on the paper feed tray TR1 are fed out by the paper feed roller Rp, and are separated and disposed one by one in the area where the retard roller Rs and the paper feed roller Rp are in contact with each other. Each separated recording sheet S is conveyed to a medium conveyance path SH. The recording sheet S in the medium conveyance path SH is conveyed to registration rollers Rr which are examples of paper feed timing adjustment members. The recording sheet S conveyed to the registration roller Rr is fed out to the secondary transfer area Q5 in synchronization with the timing when the toner images on the intermediate transfer belt B reach the secondary transfer area Q5.

From the intermediate transfer belt B where the toner images have been transferred in the secondary transfer area Q5, residual materials such as untransferred toners or corona products remaining on the surface of the intermediate transfer belt B are removed and cleaned by the belt cleaner CLb.

The recording sheet S to which the toner images have been transferred is conveyed to a fixing area Q6 of a fixing unit F. The fixing unit F has a heating roller Fh which is an example of a heating fixing member, and a pressure roller Fp which is an example of a pressure fixing member. The fixing area Q5 consists of an area where the heating roller Fh and the pressure roller Fp are in contact with each other with a predetermined pressure. The unfixed toner images on the surface of the recording sheet S are fixed by heat and pressure when the toner images pass through the fixing area Q6.

The recording medium S where the images have been fixed is conveyed in the medium conveyance path SH, and is discharged to the discharge tray TRh through discharge rollers Rh which are examples of medium discharge members.

(Description of Photoreceptor Unit)

FIGS. 4A. 4B, 4C and 4D are overall explanatory views of the photoreceptor unit according to the first embodiment. FIG. 4A is a view of the photoreceptor unit which is seen from the front, FIG. 4B is a cross-sectional view taken along the line IVB-IVB in FIG. 4A, FIG. 4C is a cross-sectional view taken along the line IVC-IVC in FIG. 4A, and FIG. 4D is a cross-sectional view taken along the line IVD-IVD in FIG. 4A.

In FIG. 4A, in the black visible image forming unit UK according to the first example, the photoreceptor Pk, the charging roller CRk, the charging roller cleaner CCk, and the photoreceptor cleaner CLk which is an example of an image retainer cleaner and an example of a storage container for a developer are constituted as a photoreceptor unit 1*k* which can be detached and exchanged from the image forming apparatus body U1 in one unit. In this instance, the photoreceptor units 1*y*, 1*m* and 1*c* for the colors Y, M and C are also constituted using the same configuration as the photoreceptor unit 1*k*.

In FIG. 4A, the photoreceptor Pk according to the first example is formed in the shape of a drum extending in the left and right direction. In the case where the photoreceptor unit 1*k* is mounted on the image forming apparatus body U1, a driven gear 2, which is an example of a gear meshed with and driven by a gear (not illustrated) of the image forming apparatus body U1, is supported on the left end portion of the photoreceptor Pk. The charging roller CRk, the charging roller cleaner CCk, and the photoreceptor cleaner CLk are also extended in the left and right direction along the photoreceptor Pk. In the first example, the photoreceptor unit 1*k* is adapted in such a way that the length of the charging roller CRk in the left and right direction is shortest. The image region L1, where the maximum image is formed, is set within both ends of the charging rollers CRk in the left and right direction, as shown in FIG. 4A.

The photoreceptor cleaner CLk includes a cleaner container 3 extending in the left and right direction which is the longitudinal direction. Both ends of the photoreceptors Py to Pk, the charging rollers Cry to CRk, and the charging roller cleaners CCy to CCk are rotatably supported on a right end wall 4 and a left end wall 5 of the cleaner container 3.

Figure 5:
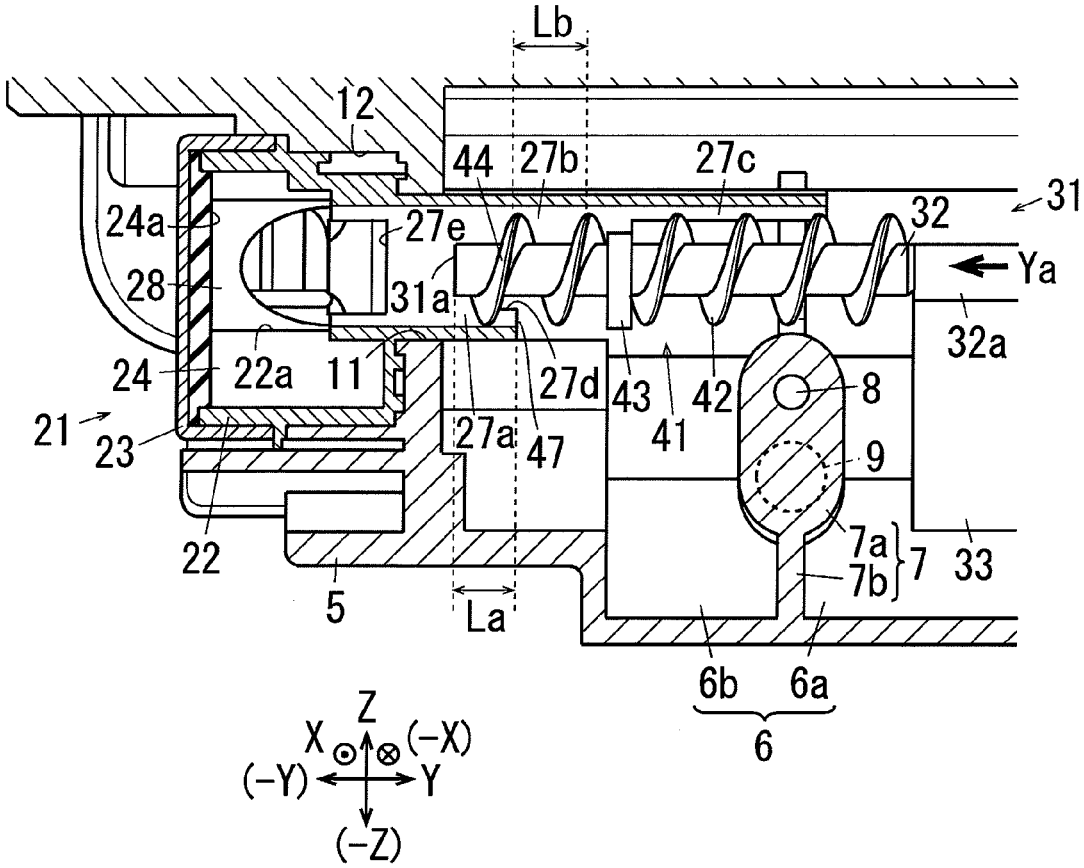
FIG. 5 is an enlarged view illustrating a major part of a left end of a photoreceptor cleaner according to the first example.

FIG. 5 is an enlarged view illustrating a major part of the left end of the photoreceptor cleaner according to the first example.

Figure 6A:
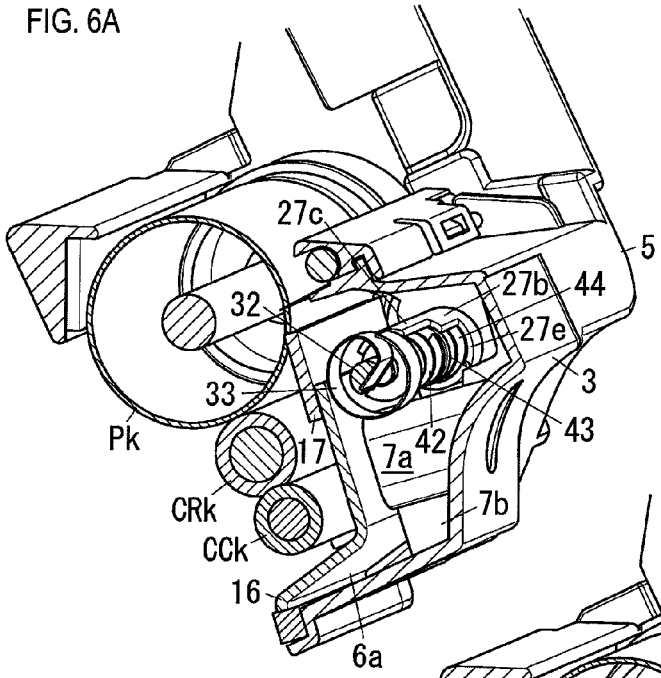
FIGS. 6A, 6B and 6C are explanatory views illustrating a major part of the photoreceptor unit according to the first example.
Figure 6B:
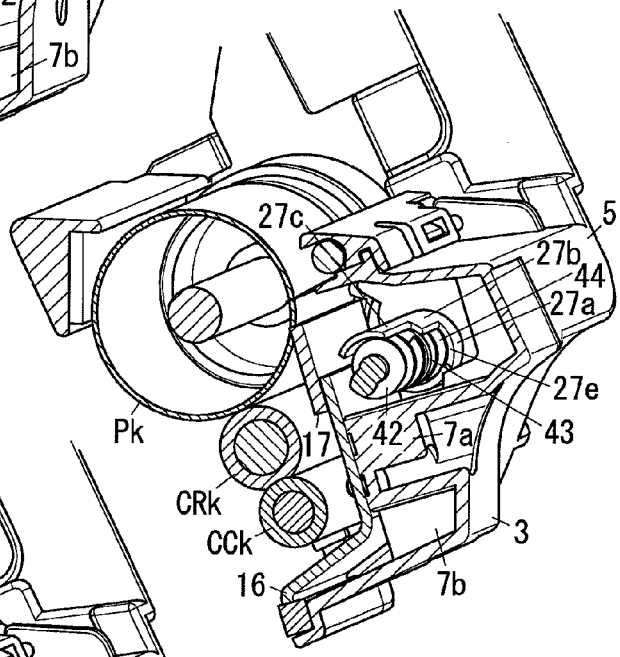
Figure 6C:
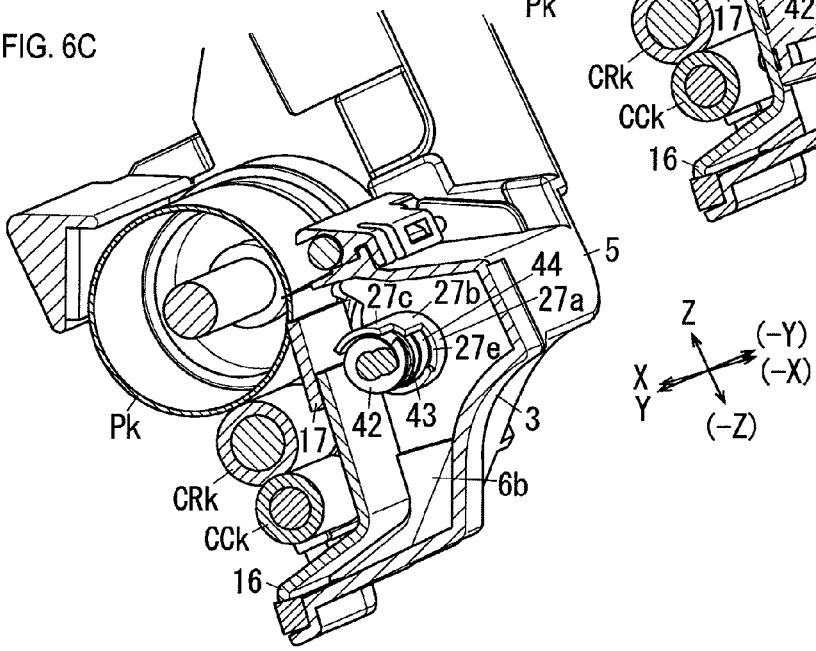

FIGS. 6A to 6C are explanatory views illustrating a major part of the photoreceptor unit according to the first example. FIG. 6A is a perspective view of the same cross-section as FIG. 4B, FIG. 6B is a perspective view of the same cross-section as FIG. 4C, and FIG. 6C is a perspective view of the same cross-section as FIG. 4D.

In FIG. 4B, FIG. 5, and FIG. 6A, a cleaner storage chamber 6, which is an example of a first storage unit, is disposed at the center portion of the cleaner storage 3 in the left and right direction to store the developer removed from the photoreceptor Pk. The cleaner storage chamber 6 according to the first example is constituted by a space having a cross section of a substantially inverted triangle, of which an upper portion protrudes rearward in comparison with a lower portion.

In FIG. 4C, FIG. 5, and FIG. 6B, a left portion of the cleaner storage chamber 6 is provided with a partition wall 7 which is an example of a partition member. The partition wall 7 according to the first example includes a blade support portion 7*a* and a partition rib 7*b*. The blade support portion 7*a* is an example of a support portion, and is disposed upward in the direction of gravity. The partition rib 7*b* is an example of a partition portion, continues downward from the lower end of the blade support portion 7*a*, and extends to the bottom surface of the cleaner storage chamber 6. The blade support portion 7*a* according to the first example is provided with a screw hole 8 which is an example of an upper fixing portion, and a positioning protrusion 9 which is an example of a lower positioning portion.

In this instance, the partition wall 7 according to the first example is disposed at the right side, that is, the inside of the image region L1, rather than the left end of the image region L1.

Accordingly, the cleaner storage chamber 6 according to the first example is partitioned into an upstream chamber 6*a* and a downstream chamber 6*b* by the partition wall 7. The upstream chamber 6*a* is an example of an upstream storage unit, and is disposed at the center in the left and right direction. The downstream chamber 6*b* is an example of a downstream storage unit, and is disposed at the left side in the left and right direction.

In addition, while a blade support portion which fairs up with the blade support portion 7*a* is disposed at the right end of the cleaner container 3, the partition rib 7*b* is not provided at the right end. That is, the right end of the cleaner container 3 is not provided with a chamber partitioned from the upstream chamber 6*a* such as the downstream chamber 6*b*. In this instance, since the right blade support portion has the same configuration as the left blade support portion 7*a*, it is not shown so as to simplify the description.

In FIG. 5, the left end wall 5 of the cleaner container 3 is provided with an opening 11 which penetrates the wall in the left and right direction, and the outside of the left end wall 5 is provided with a support concave portion 12. The support concave portion 12 is an example of a support portion for detection, and is formed in the shape of a concave portion.

In FIGS. 4A, 4B, 4C and FIG. 5 and FIGS. 6A, 6B and 6C, the blade support portion 7*a* supports a plate-shaped blade holder 16 which is an example of a support member for a cleaner member, and extends in the left and right direction. A proximal end 17*a* of the cleaning blade 17, which is an example of the cleaning member, is fixed and supported on the upper end of the blade holder 16. The cleaning blade 17 is in contact with the surface of the photoreceptor Pk at the front end 17*b* thereof at a predetermined contact pressure, thereby removing and cleaning the developer and corona products remaining on the surface of the photoreceptor Pk. Accordingly, the developer or the like removed from the photoreceptor Pk drops and is stored in the cleaner container 3.

In this instance, the blade holder 16 and the cleaning blade 17 according to the first example are disposed to close the left direction the cleaner container 3. The cleaner storage chamber 6 having the upstream chamber 6*a* and the downstream chamber 6*b* is formed by the space enclosed by the cleaner container 3, the blade holder 16 and the cleaning blade 17.

Figure 7B:
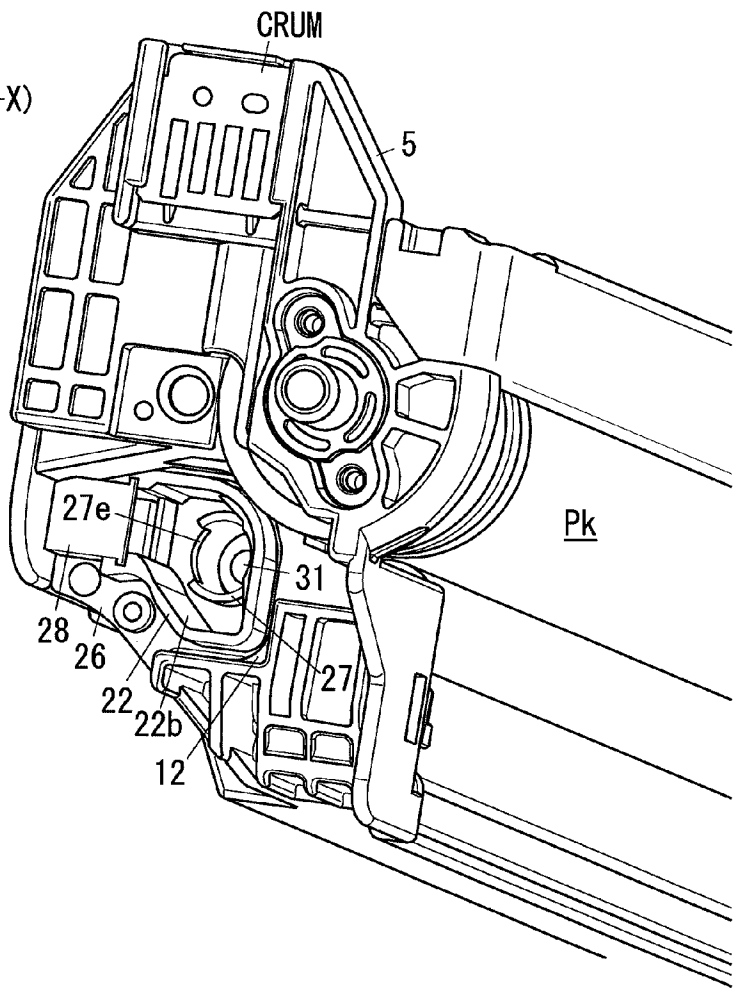
Figure 7A:
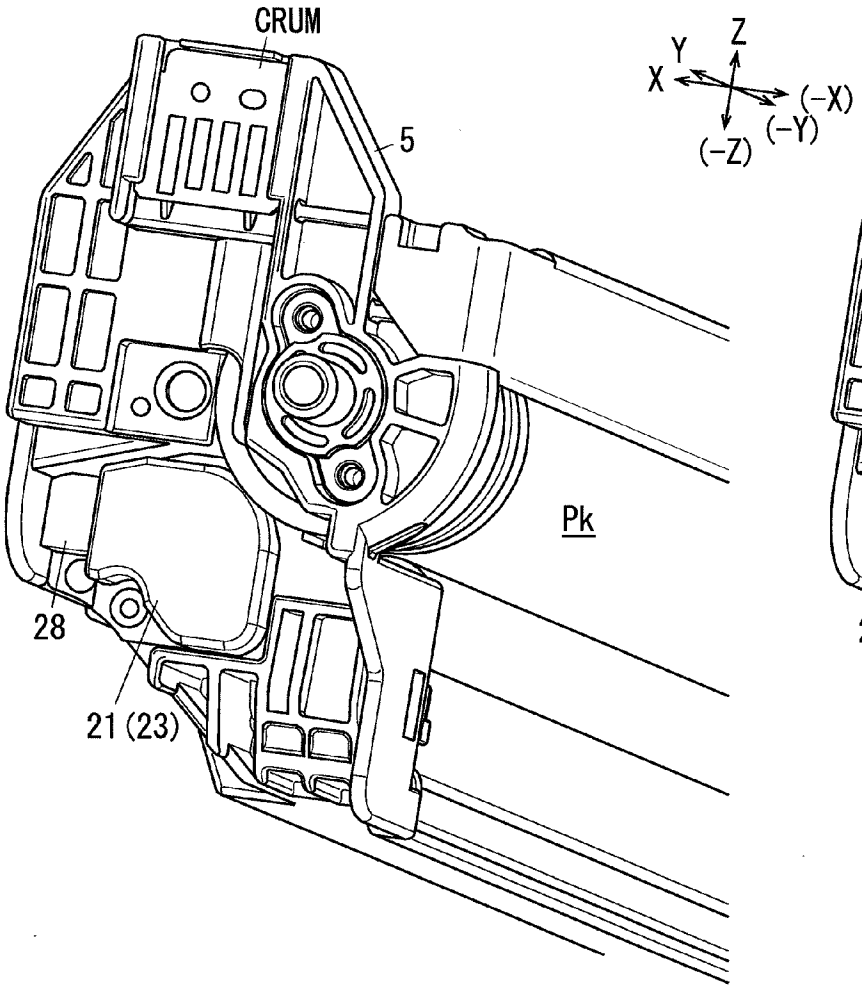

FIGS. 7A and 7B are perspective views illustrating the image retainer unit seen from below and the left at an angle. FIG. 7A is an explanatory view illustrating a major part of a detection storage unit, and FIG. 7B is an explanatory view illustrating a major part of a detection storage unit in a state where a cover member is removed from the detection storage unit.

In FIGS. 5 to 7B, a detection buffer member 21 which is an example of a detection storage member is supported on the support concave portion 12 formed on the left end wall 5 of the cleaner container 3. In FIGS. 7A and 7B, the detection buffer member 21 has a cylindrical detection buffer body 22 with an opened rear portion, and a buffer cover 23. The detection buffer body 22 is an example of a storage body, as shown in FIG. 7B, and extends in the left and right direction. The buffer cover 23 is an example of a cover member for covering the buffer body 22 in the left direction. Accordingly, as shown in FIG. 5, a buffer chamber 24 which is an example of a storage chamber is formed in the detection buffer member 21 by the space enclosed by the detection buffer body 22 and the buffer cover 23.

In FIG. 5 and FIG. 7B, the rear upper portion of the left end of the detection buffer body 22 is provided with an outlet port 22*a* opened toward the rear. The detection buffer body 22 is provided with an inclined surface 22*b* which is slanted downwardly at an angle from the outlet port 22*a*.

Figures 8A, 8B, 8C, 8D, 8E:
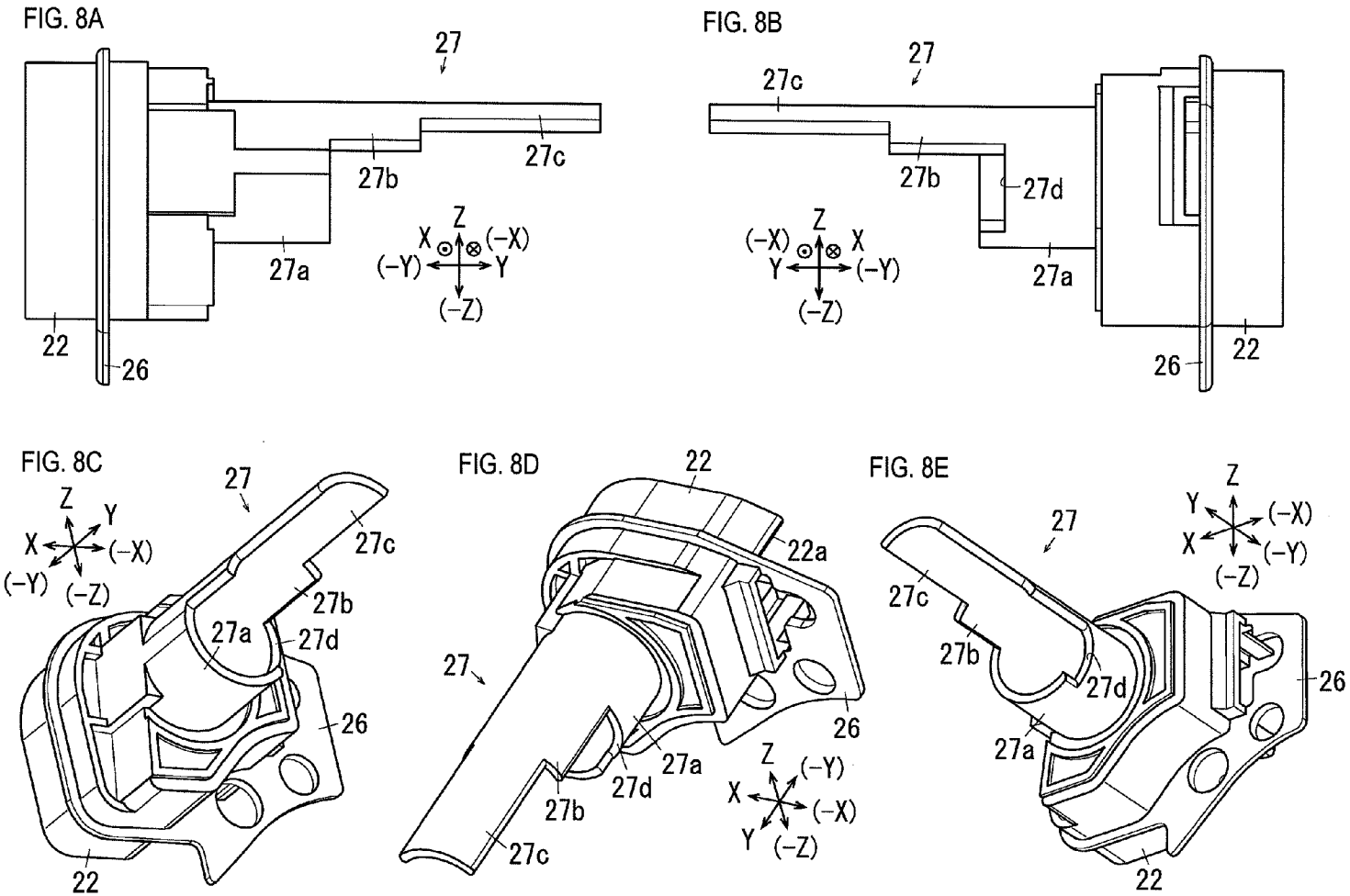

FIGS. 8A to 8E are explanatory views illustrating the detection storage unit according to the first example. FIG. 8A is a side view of the detection storage unit seen from the front, FIG. 8B is a side view of the detection storage unit seen from the rear, FIG. 8C is a perspective view of the detection storage unit from seen the rear and right at an angle, FIG. 8D is a perspective view of the detection storage unit seen from above and behind at an angle, and FIG. 8E is a perspective view of the detection storage unit seen from below and the rear at an angle.

In FIG. 5, FIGS. 7A and 7B, and FIGS. 8A to 8E, the center portion of the detection buffer body 22 is provided with a plate-shaped flange portion 26 which is an example of a support target portion. The flange portion 26 is fixed to the support concave portion 12 by means of a screw (not illustrated) or the like.

In addition, the upper portion of the detection buffer body 22 is provided with an inlet guide portion 27 which is an example of a guide portion for the developer and an example of a third storage unit. The inlet guide portion is formed in a cylindrical shape extending in the left and right direction, and penetrates the opening 11 of the cleaner container 3 and extends to the cleaner storage chamber 6.

In FIG. 5, FIGS. 6A to 6C, and FIGS. 8A to 8E, the inlet guide portion 27 has a main guide portion 27*a* of a cylindrical shape which is an example of a main guide portion and is disposed at the left end of the main guide portion. The right end of the main guide portion 27*a* is provided with a first cover portion 27*b* of a partially annular shape which is an example of a first regulation member. The first cover portion 27*b* is formed continuously with the main guide portion 27*a*, and is disposed at the upper end of the main guide portion 27*a* in the direction of gravity. In addition, the right end of the first cover portion 27*b* is provided with a second cover portion 27*c* of a partially annular shape which is an example of a second regulation member. The second cover portion 27*c* is formed to have a center angle smaller than that of the first cover portion 27*b*, and is formed continuously with the first cover portion 27*b*. As shown in FIG. 5, the right end of the second cover portion 27*c* according to the first example is set at a position corresponding to the partition wall 7 of the cleaner wall 3.

In FIG. 5, FIGS. 6A to 6C, FIG. 8B, FIG. 8E, and FIG. 8E, the rear end of the main guide portion 27*a* is provided with a first cutaway portion 27*d* which is an example of an outlet portion and an example of a backflow permitting portion. The first cutaway portion 27*b* extends in the left and right direction, and is partially cut away.

In FIG. 5 and FIG. 7B, the left portion of the main guide portion 27*a* is provided with a second cutaway portion 27*e* which is an example of a developer guide portion. Similar to the first cutaway portion 27*d*, the second cutaway portion 27*e* has a cutaway rear side corresponding to the outlet port 22*a* in the buffer chamber 24.

As shown in FIG. 5 to FIG. 7B, according to the first example, the height of the inlet guide portion 27 in the direction of gravity is set to correspond to the height of the inlet portion 22*a*.

Figure 9A:
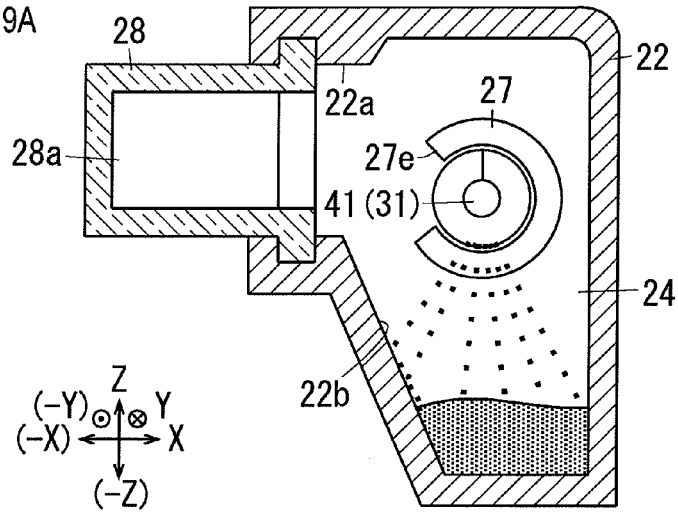
Figure 9B:
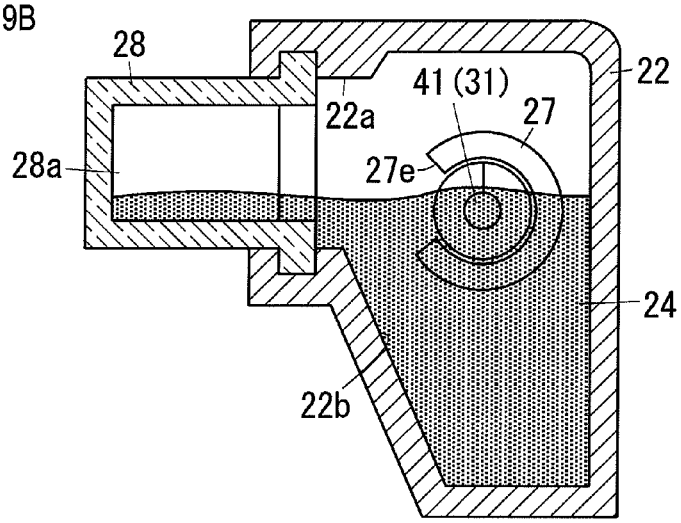
Figure 9C:
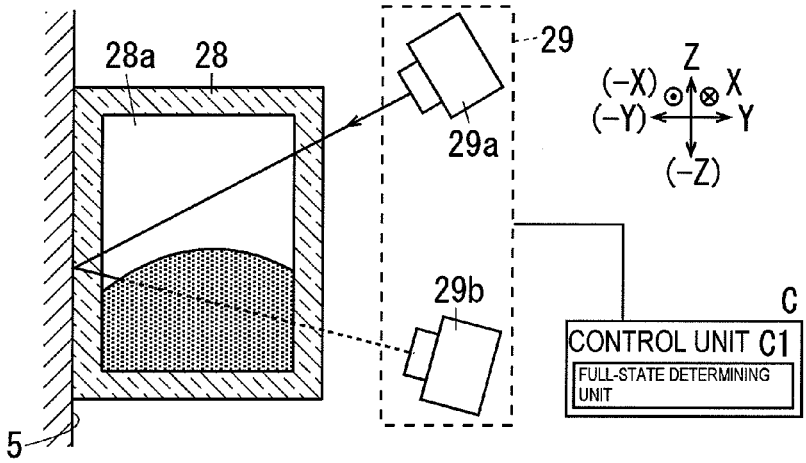

FIGS. 9A, 9B and 9C are explanatory views illustrating a detection target portion according to the first example. FIG. 9A is an explanatory view illustrating the state in which the developer starts to flow in the detection storage unit, FIG. 9B is an explanatory view illustrating the state in which the developer flows to the inside of the detection target portion, and FIG. 9C is an explanatory view of the detection member.

In FIGS. 7A and 7B, and FIG. 9A to 9C, a box-shaped detection box 28 is supported on the rear portion of the detection buffer member 21. The detection box 28 is an example of the detection target portion, and a position of the detection box corresponding to the outlet port 22*a* is opened. The detection box 28 is made of a transparent material through which light can pass. The detection box 28 is provided therein with a detection chamber 28*a* which is an example of a second storage unit. The detection chamber 28*a* is able to accommodate the developer discharged from the outlet port 22*a*. In FIG. 9C, the image forming apparatus body U1 is provided with an optical sensor 29, which is an example of the detection member, at the position corresponding to the detection box 28. The optical sensor 29 has a light emitting portion 29*a* for emitting light, and a light receiving portion 29*b* for receiving reflected light. If the developer is present in the detection box 28, the light from the light emitting portion 29*a* is shielded by the developer.

In the case where the photoreceptor unit 1*k* is mounted on the image forming apparatus body U1, the optical sensor 29 is disposed at the position opposite to the detection box 28. Accordingly, if the light receiving portion 29*b* receives the light, a full-state determining unit C1 of the control unit C which transmits and receives the controls signal from the optical sensor 29 determines that the cleaner container 3 is not full based on the detected result of the optical sensor 29. As shown in FIGS. 9B and 9C, if the light receiving portion 29*b* does not receive the light, the developer is present in the detection box 28, and thus the full-state determining unit C1 determines that the cleaner container 3 is a full state of developer.

In the printer U according to the first example, if it is determined that the photoreceptor cleaners CLy to CLk are full, a display unit (not illustrated) of the image forming apparatus body U1 is operated by the control unit C to display information of urging a user to replace the photoreceptor units 1*y* to 1*k*.

In FIGS. 7A and 7B, a memory member CRUM is supported on the upper end of the left end wall 5. The memory member CRUM stores information on the photoreceptor unit 1*k* such as cumulative number of rotations and cumulative rotating time of the photoreceptor Pk, cumulative numbers of prints, and whether or not the cleaner container 3 is full. The memory member CRUM is constituted by a circuit board having electron elements and electric circuit. In the state in which the photoreceptor unit 1*k* is mounted on the image forming apparatus body U1, the memory member CRUM is connected to a connection terminal (not illustrated) supported by the image forming apparatus body U1, and the information is read from or written to the memory member in accordance with the control signal from the control unit C.

(Description of Conveyance Member)

Figure 10A:
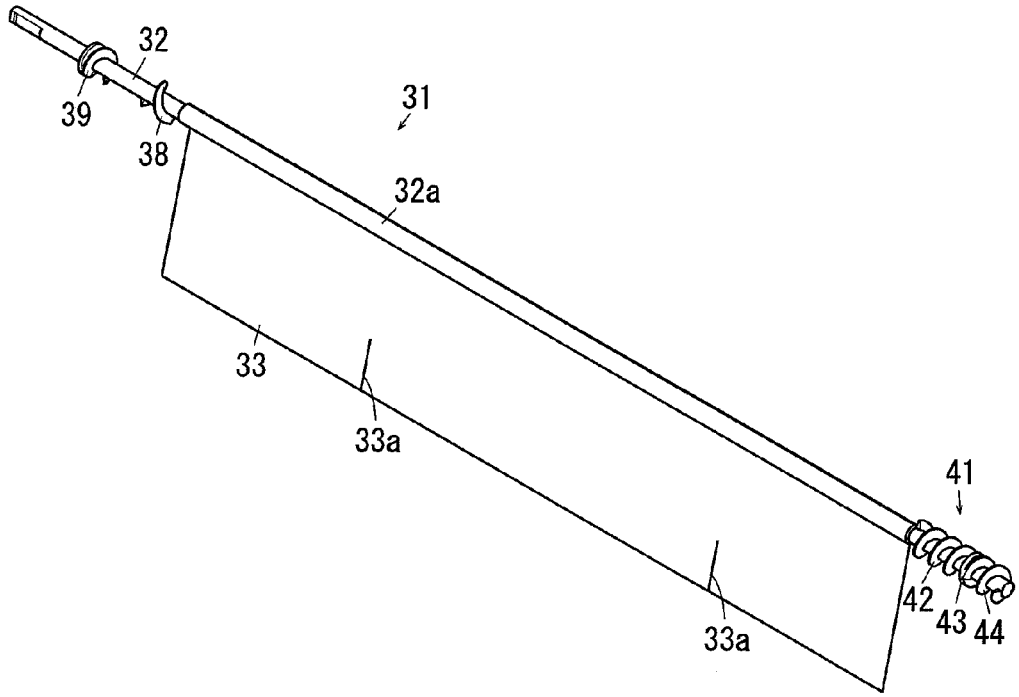
Figure 10B:
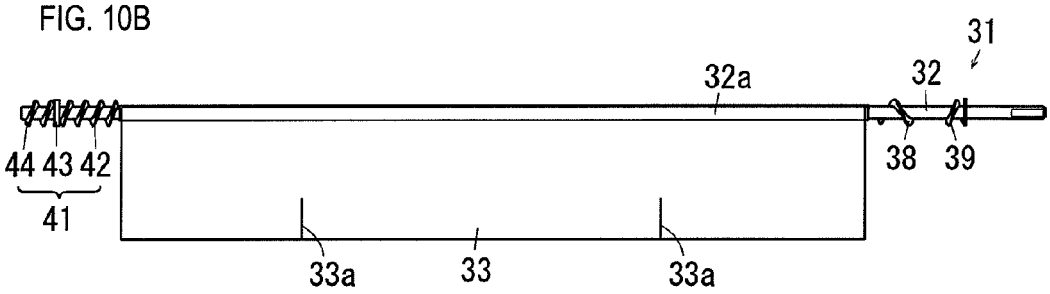

FIGS. 10A and 10B are explanatory views illustrating a conveyance member according to the first example. FIG. 10A is a perspective view, and FIG. 10B is a side view.

Figure 11A:
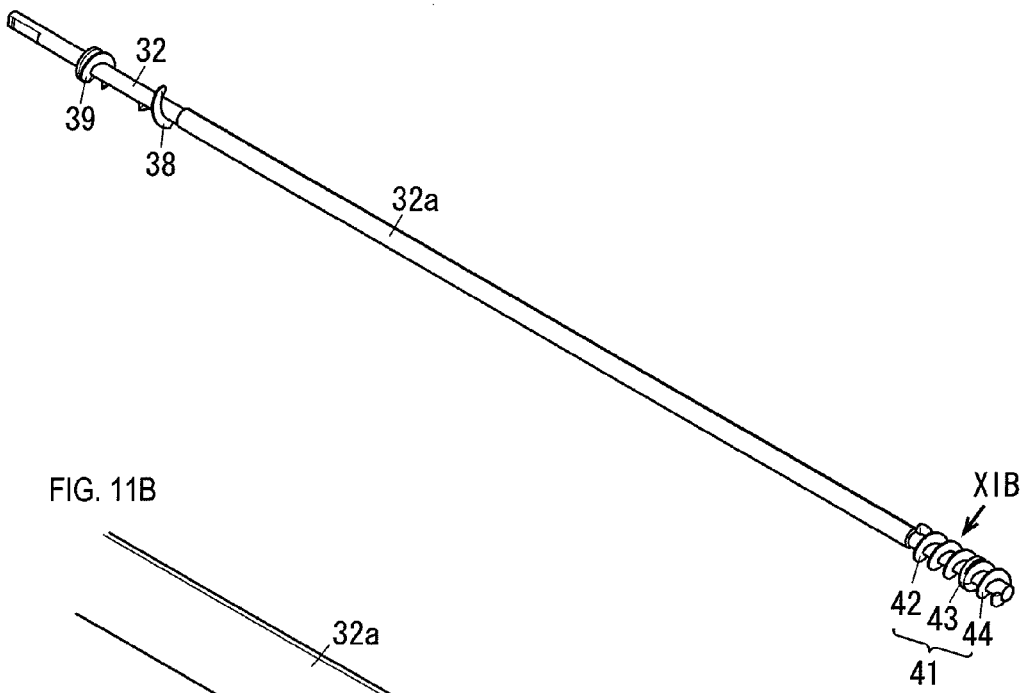
Figure 11B:
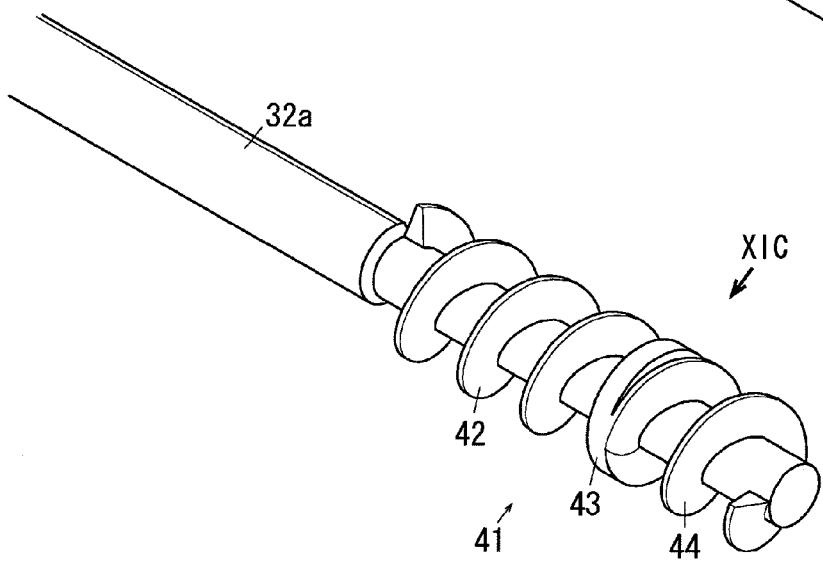
Figure 11C:
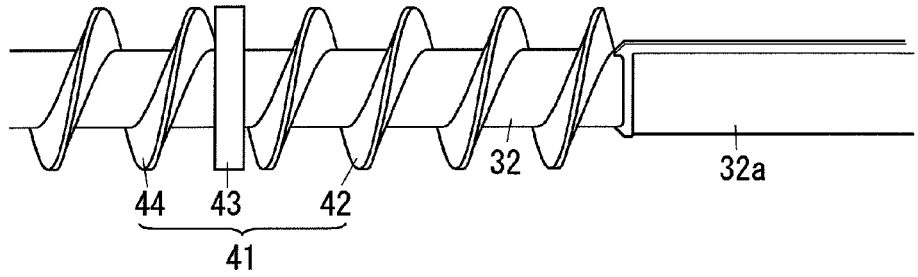

FIGS. 11A, 11B and 11C are explanatory views illustrating a shaft portion of the conveyance member according to the first example. FIG. 11A is a perspective view, FIG. 11B is an enlarged explanatory view of the portion indicated by the arrow XIB in FIG. 11A, and FIG. 11C is a view seen from a direction of the arrow XIC in FIG. 11B.

In FIG. 5 and FIGS. 6A to 6C, a conveyance auger 31 is disposed in the cleaner container 3 according to the first embodiment. The conveyance auger 31 is an example of a conveyance member, and extends in the left and right direction which is the longitudinal direction. In FIG. 5, FIGS. 6A to 6C, FIGS. 10A and 10B, and FIGS. 11A, 11B and 11C, the conveyance auger 31 according to the first example has a rod-shaped shaft portion 32 which is an example of a rotational shaft and extends in the left and right direction.

In FIG. 5, in the conveyance auger 31 according to the first example, one end of the conveyance auger 31, that is, the left end 31*a*, is disposed in the state in which it is accommodated in the main guide portion 27*a* of the inlet guide portion 27. The left end 31*a* is disposed in a state in which there is a gap formed between the left end 31 and the left end 24*a* of the buffer chamber 24. Accordingly, one end of the axial portion 32, that is, the left end 31*a*, is set as a free end. Therefore, the conveyance auger 31 according to the first example is rotatably supported on the cleaner container 3 in a cantilever state in which only the right end, which is an example of the other end of the shaft portion 32, is supported by the right end wall 4 of the cleaner container 3. The term "cantilever state" means that one end is fixed but other end is not fixed.

Figure 12A:
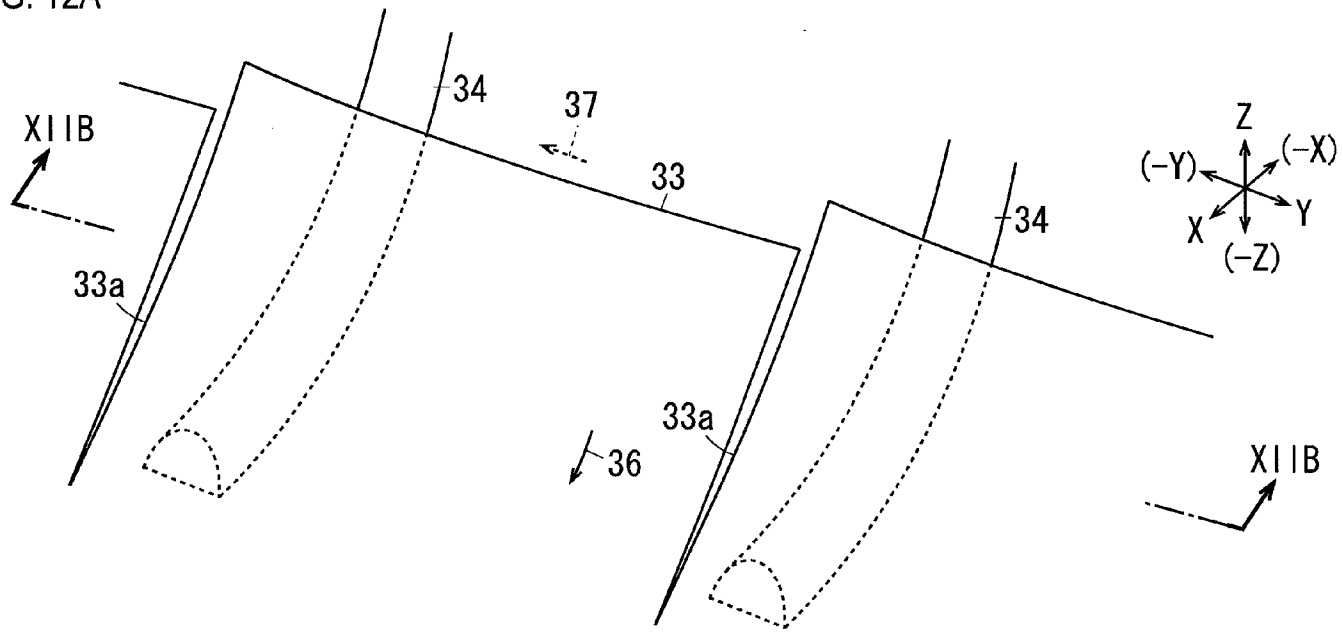
Figure 12B:
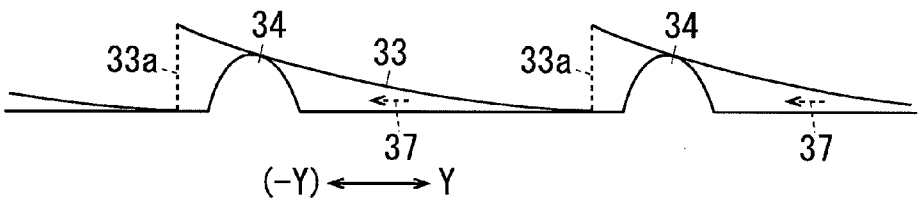

FIGS. 12A and 12B are explanatory views illustrating the relationship between a slit and a protruding strip in a leveling member. FIG. 12A is a perspective view a major part, and FIG. 12B is a cross-sectional view taken along the line XIIB-XIIB in FIG. 12A.

In FIGS. 10A and 10B and FIGS. 11A, 11B and 11C, a center portion of the shaft portion 32 in the left and right direction is provided with a film support portion 32*a* which is an example of an attachment portion. The film support portion 32*a* is formed in the shape of a so-called D cut by partially cutting the cylindrical shaft portion 32. A flexible conveyance film 33 is fixed and supported on the film support portion 32*a*. The conveyance film 33 is an example of the conveyance member and an example of the leveling member. The conveyance film 33 is provided with a plurality of slit portions 33*a* extending along the diameter direction of the shaft portion 32 and spaced apart from each other at an interval in the left and right direction. In FIGS. 12A and 12B, the inner surface of the cleaner container 3 is provided with a conveyance rib 34, which is an example of the protruding strip, adjacent to the right side with respect to the position of the slit portion 33*a* of the conveyance film 33. As shown in FIGS. 12A and 12B, the conveyance film 33 is configured such that the left end of the slit portion 33*a* of the conveyance film 33 gets on the conveyance rib 34 to come into contact with each other.

Accordingly, as the shaft portion 32 rotates to rotate the conveyance film 33 in the direction of the arrow 36, when the developer accommodated in the cleaner container 3 is not uniformly distributed in the left and right direction which is the longitudinal direction so that the heaps of developer form peaks or valleys, the peaks or valleys are leveled by the conveyance film 33. At the same time, the conveyance film 33 getting on the conveyance rib 34 conveys the developer in the left direction which is a direction indicated by the arrow 37, by a weak conveyance force. That is, the developer in the cleaner container 3 is leveled by the conveyance film 33, and is fed to lean slightly toward the left where the full state is detected. Consequently, in a case where the developer leans toward the right, there is a concern that even though the right of the cleaner storage chamber 6 is full, it is not detected as the full, and thus the developer may overflow from the right of the cleaner container 3. However, in the configuration, where the developer is leveled and does not lean to the right, according to the first example, it is possible to detect the full state before the developer overflows from the cleaner container 3.

The shaft portion 32 is provided with a right conveyance portion 38 at the right of the film support portion 32*a*. The right conveyance portion 38 is spirally formed in the winding direction to convey the developer in the right direction when the shaft portion 32 is rotated. Also, the shaft portion 32 is provided with a reverse conveyance portion 39 at the right of the right conveyance portion 38. The reverse conveyance portion 39 is formed to have a spiral of the opposite direction to the winding direction of the right conveyance portion 38 to convey the developer in the left direction. Consequently, the developer dropping in the storage chamber 6 further to the right than the right end of the conveyance film 33 is conveyed and heaped to the right of the storage chamber 6 by the right conveyance portion 38 and the reverse conveyance portion 39, and simultaneously is leveled by agitation, thereby suppressing the excessive leaning of the developer.

In FIG. 5, FIGS. 6A to 6C, FIGS. 10A and 10B, and FIGS. 11A, 11B and 11C, the shaft portion 32 is provided with a left conveyance portion 41 at the left of the film support portion 32*a* to convey the developer in the left direction. The left conveyance portion 41 according to the first example has an upstream conveyance portion 42 which is an example of a first conveyance portion. The upstream conveyance portion 42 is disposed adjacent to the left of the film support portion 32*a*, and is formed to have a spiral in the same winding direction as the reverse conveyance portion 39 to convey the developer in the left direction, that is, toward the detection buffer member 21 as the shaft portion 32 is rotated.

The shaft portion 32 is also provided with a leveling portion 43 at the left of the upstream conveyance portion 42, that is, to the downstream side in the conveyance direction Ya of the developer. The leveling portion 43 is an example of a second conveyance portion, and is formed in the shape of disk perpendicular to the axial direction of the shaft portion 32. In addition, the shaft portion 32 is provided with a downstream conveyance portion 44, which is an example of a third conveyance portion, at the left of the leveling portion 43. The downstream conveyance portion 44 is formed to have a spiral in the same winding direction as the upstream conveyance portion 42 to convey the developer in the conveyance direction Ya as the shaft portion 32 is rotated.

Accordingly, the left conveyance portion 41 according to the first example is set such that the conveyance speed at the leveling portion 43 at a midstream is lower than those at the upstream conveyance portion 42 and the downstream conveyance portion 44, and in the first example, the conveyance speed of the developer at the leveling portion 43 is set to be zero.

As shown in FIG. 5, in the left conveyance portion 41 according to the first example, the upstream conveyance portion 42 is formed from the right direction than the blade support portion 7*a*, and is formed to the left direction than the blade support portion 7*a*. Accordingly, as shown in FIGS. 6B and 6C, the left portion of the upstream conveyance portion 42 is covered by the second cover portion 27*c* at the upper side thereof. The upstream conveyance portion 42 is configured such that, when the developer removed by the cleaning blade 17 drops into the cleaner storage chamber 6 from above, the developer does not directly drop into the upstream conveyance portion 42.

The leveling portion 43 is disposed at the border between the first cover portion 27*b* and the second cover portion 27*c*, and is disposed closer to the downstream side of the conveyance direction Ya more than the blade support portion 7*a*. In addition, the downstream conveyance portion 44 is disposed closer to the downstream side of the conveyance direction Ya than the first cover portion 27*b*, and is configured such that the developer dropping from above does not directly drop into the downstream conveyance portion 44.

In the conveyance auger 31 according to the first example, as shown in FIG. 5, the downstream end portion, which is an example of one end of the conveyance auger 31 in a cantilever state, is supported in such a way that the outer peripheral surface of the spiral downstream conveyance portion 44 is in contact with the inner peripheral surface of the main guide portion 27*a*. Accordingly, the left portion of the conveyance auger 31 is rotatably supported by the main guide portion 27*a*, so that the rotation of the conveyance auger 31 is stabilized, as compared with the case of the cantilever state in which the left portion is not supported in a unitary body.

In FIG. 5, according to the first example, the length La from the downstream end of the downstream conveyance portion 44, that is, the left end 31*a* of the conveyance auger 31, to the upstream end 47 of the main guide portion 27*a* is set to be shorter than the length, a so-called pitch Lb, of the spiral traveling in the axial direction of rotation in a case where the conveyance auger 31 is rotated once. That is, the length La is set to be less than 1 pitch of the downstream conveyance portion 44.

(Operation of First Example)

Figure 13A:
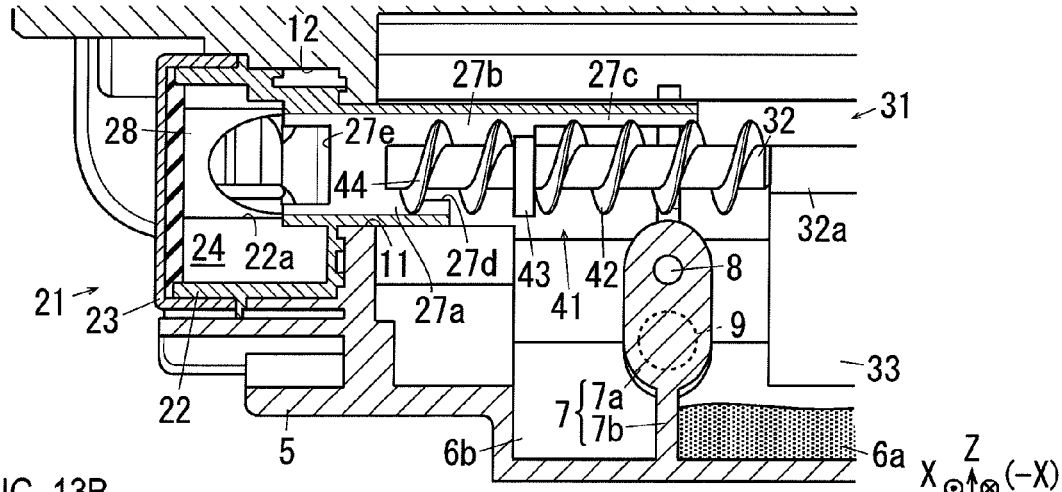
Figure 13B:
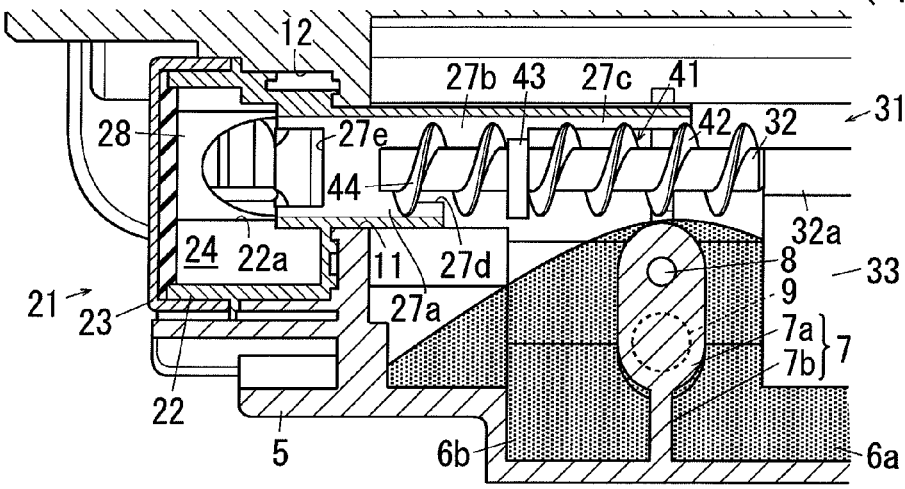
Figure 13C:
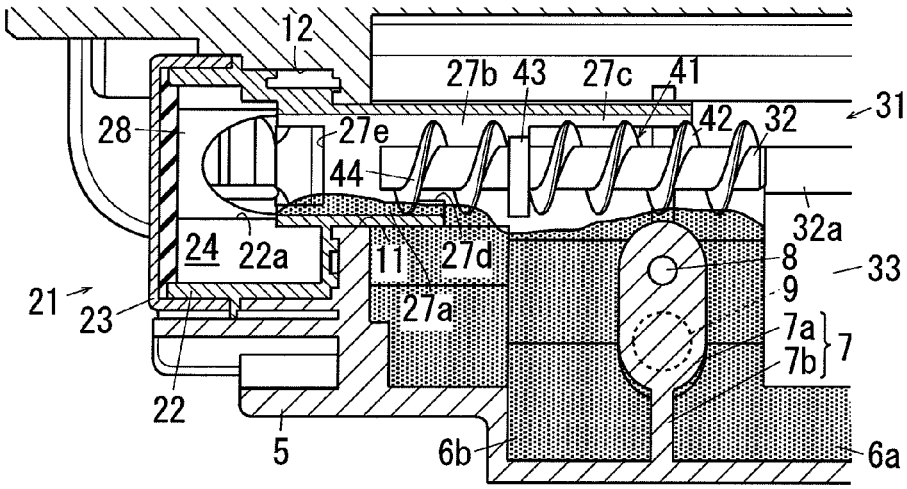

FIGS. 13A, 13B and 13C are explanatory views corresponding to FIG. 5 illustrating the amount of developer collected in the cleaner according to the first example. FIG. 13A is an explanatory view illustrating the state in which the amount of the developer collected is small, FIG. 13B is an explanatory view illustrating the state in which the developer starts to flow in the downstream chamber, and FIG. 13C is an explanatory view illustrating the state in which the developer starts to flow in the buffer chamber from the downstream chamber.

In the printer U including the above-described configuration according to the first example, if the developer remaining on the surfaces of the photoreceptors Py to Pk after the primary transfer is removed by the cleaning blade 17, the developer drops into the cleaner storage chamber 6 and then is deposited therein. The conveyance film 33 is disposed in the upstream chamber 6*a* of the cleaner storage chamber 6, and the collected developer is leveled by the rotation of the conveyance film 33, as shown in FIG. 13A. Consequently, before the developer leans toward the right direction or the left direction and thus the inside of the upstream chamber 6*a* is filled with the developer, the inflow of the developer into the downstream chamber 6*b* is reduced.

In particular, according to the first example, the upstream chamber 6*a* and the downstream chamber 6*b* are partitioned by the partition wall 7, so that the inflow of the developer to the downstream chamber 6*b* from the upstream chamber 6*a* is reduced before the upstream chamber 6*a* is full. Accordingly, for example, even if the user tilts the photoreceptor units 1*y* to 1*k* by mistake in the state in which the developer is stored in the upstream chamber 6*a*, the developer hardly flows in the downstream chamber 6*b* from the upstream chamber 6*a*, and thus the developer hardly flows to the detection chamber 28*a* from the downstream chamber 6*b*. Therefore, the error detection of the full state is reduced in comparison with the configuration in which the upstream chamber 6*b* and the downstream chamber 6*b* are not partitioned.

In this instance, the partition wall 7 is disposed in the image region L1, and the developer removed by the cleaning blade 17 at the left end of the photoreceptors Py to Pk possibly drops toward the left conveyance portion 41. In order to cope with this, in the first example, the cover portions 27*b* and 27*c* are provided to reduce the fact that the dropping developer directly drops into the left conveyance portion 41. Accordingly, the developer adhered to the left conveyance portion 41 is conveyed to the inlet guide portion 27 or the buffer chamber 24 by the rotation of the conveyance auger 31. Before the upstream chamber 6*a* and the downstream chamber 6*b* is filled with the developer, the developer is deposited in the buffer chamber 24 or the detection chamber 28*a*, thereby reducing the error detection of the full.

In particular, since the second cover portion 27*c* is installed to the upper portion of the blade support portion 7*a*, adverse effects can be reduced, for example, the developer drops between the blade support portion 7*a* and the left conveyance portion 41 and then is conveyed to the downstream side, or the developer is mixed in the left conveyance portion 41 so that the developer is applied with a load to decrease the flowability thereof.

Figure 14A:
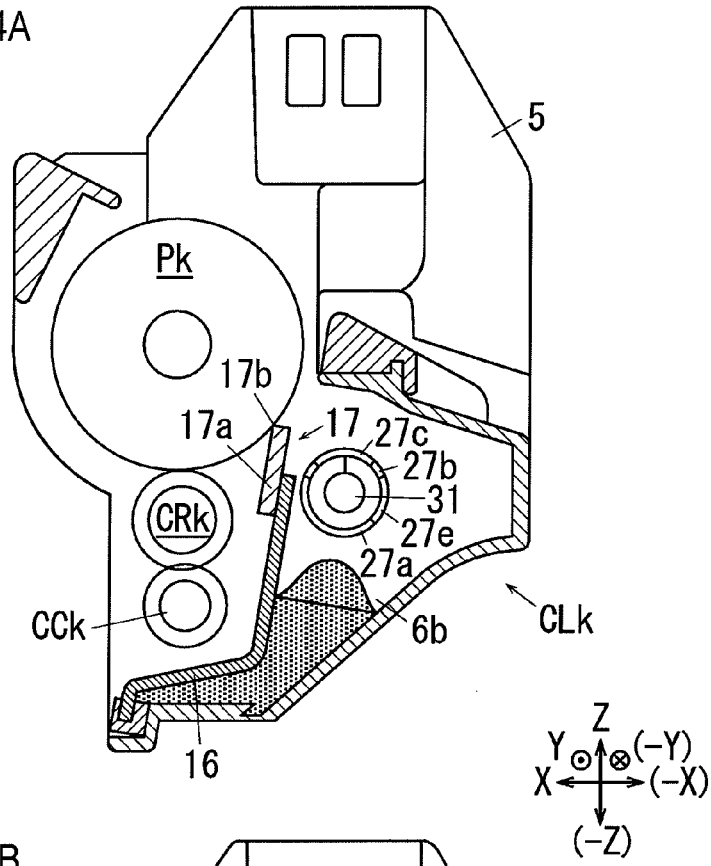
Figure 14B:
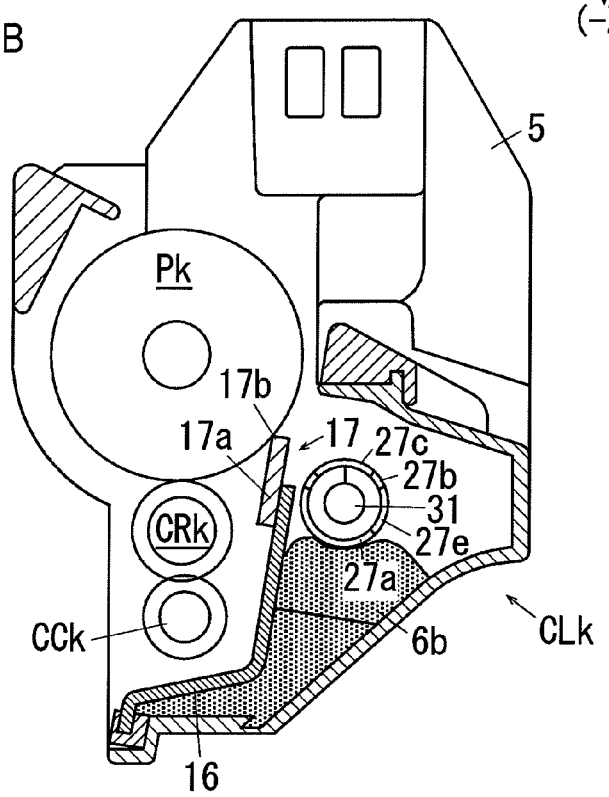

FIGS. 14A and 14B are explanatory views corresponding to FIG. 4D illustrating the amount of developer collected in the cleaner according to the first example. FIG. 14A is an explanatory view corresponding to FIG. 13B, and FIG. 14B is an explanatory view corresponding to FIG. 13C.

In FIGS. 13A and 13B, if the amount of the developer stored in the upstream chamber 6*a* is increased and thus is deposited to a certain extent to overflow the partition wall 7, the developer overflows the partition wall 7, or is conveyed by the upstream conveyance 42 of the left conveyance portion 41 to the downstream portion 6*b* on the downstream side.

In FIG. 14A, if the developer starts to be conveyed to the downstream portion 6*b* by the conveyance auger 31, the developer deposited in the downstream chamber 6*b* is likely to be deposited in the shape of peak under the left conveyance portion 41 which is a member for conveying the developer, as shown in FIG. 14A.

Accordingly, in the configuration in which the leveling portion 43 is not provided, and the upstream conveyance portion 42 and the downstream conveyance portion 44 are continuously formed, similar to the conventional configuration, before the downstream chamber 6*b* is filled with the developer, the developer positioned at the top portion of the peak of the deposited developer starts to be conveyed to the downstream side. As a result, before the upstream chamber 6*a* or the downstream chamber 6*b* is full, the developer reaches the detection chamber 28*a*, which may wrongly detect the developer as a full.

By contrast, in the photoreceptor cleaners CLy to CLk according to the first example, since the leveling portion 43 with low conveyance speed is disposed between the upstream conveyance portion 42 and the downstream conveyance portion 44, the flowing speed of the developer to the downstream side is decreased, so that the developer is likely to stay at the leveling portion 43. In particular, in the first example, since the conveyance speed of the leveling portion 43 is zero, the developer is likely to stay. Accordingly, as compared with the conventional configuration in which the portion with the low conveyance speed, that is, the leveling portion 43, is not provided, the developer is likely to be deposited in the downstream chamber 6*b*, thereby decreasing the case where the developer flowing in the downstream chamber 6*b* is shifted to the downstream conveyance portion 44 and thus is quickly conveyed to the downstream side, thereby reducing the error detection of the full.

In FIG. 13B, FIG. 13C, FIG. 14A and FIG. 14B, in particular, the leveling portion 43 according to the first example is made of a disc-shaped member, and levels the developer in the peak shape by the rotation of the shaft portion 32. Accordingly, since the developer in the peak shape is likely to collapse, a lot of developers are deposited in the downstream chamber 6*b*, that is, sufficient amounts of the developers are deposited in the downstream chamber 6, as shown in FIG. 13C and FIG. 14B, and then the downstream conveyance portion 44 starts to convey the developer to the downstream side, as compared with the configuration in which the leveling portion 43 is not installed. Accordingly, it is possible to reduce the error detection of the full state before the cleaner storage chamber 6 is full.

In addition, in the first example, since the first cover portion 27*b* is disposed to cover the upper portion of the left conveyance portion 41, the developer dropping from above is hardly deposited on the peak of the developer. Accordingly, in particular, the downstream conveyance portion 44 of the left conveyance portion 41 which is disposed corresponding to the first cover portion 27*b* having a wider covering region than the second cover portion 27*c* hardly conveys quickly the developer dropping from above to the downstream side. However, the downstream conveyance portion 44 easily conveys the developer which is deposited in the downstream chamber 6*b* and is stacked from the bottom. Accordingly, the developer removed by the photoreceptors Py to Pk and then just dropping is quickly conveyed to the downstream side, thereby reducing the error detection of the full.

In FIGS. 9A and 9B, according to the first example, since the buffer chamber 24 is interposed between the downstream chamber 6*b* and the detection chamber 28*a*, the direct inflow of the developer from the cleaner storage chamber 6 to the detection chamber 28*a* is reduced. Accordingly, for example, when the user tilts the photoreceptor units 1*y* to 1*k* by mistake in the state in which the developer is stored in the cleaner storage chamber 6, the developer hardly flows from a gap between the conveyance auger 31 and the inlet guide portion 27. Even though the developer is wrongly sent before the upstream chamber 6*a* or the downstream chamber 6*b* is full, the developer does not directly enter into the detection chamber 28*a*, and is temporarily stored in the buffer chamber 24. In particular, according to the first example, since the height of the inlet guide portion 27 in the direction of gravity is set to be substantially equal to the height of the outlet portion 22*a*, that is, the inlet of the detection chamber 28*a*, the developer from the inlet guide portion 27 is likely to drop into the buffer chamber 24 by the action of gravity, and is difficult to directly flow in the detection chamber 28*a*. Accordingly, the error detection is reduced as compared with the configuration in which the buffer chamber 24 is not installed.

According to the first example, since the detection box 28 is disposed at the upper portion of the buffer chamber 24 in the direction of gravity, as shown in FIG. 9B, after the buffer chamber 24 is filled with the toner, the developer flows in the detection chamber 28*a*, and then the detection of the full state is carried out. Therefore, the error detection is reduced as compared with the case where the developer directly flows in the detection chamber 28*a*.

In addition, according to the first example, since the buffer chamber 24 is provided with the inclined surface 22*b* which is slanted downwardly at an angle from the outlet portion 22*a*, the developer deposited leaning toward the detection chamber 28*a* is likely to slide and drop into the bottom of the buffer chamber 24. Therefore, the detection of the developer in the detection chamber 28*a* is reduced before the developer is sufficiently stacked in the buffer chamber 24.

Further, according to the first example, the conveyance auger 31 is supported in a cantilever state, and the left end which is the downstream side in the conveyance direction Ya is the free end. After the developer starts to be conveyed from the downstream chamber 6*b* to the buffer chamber 24, if the amount of the developer is increased in the buffer chamber 24, the developer may be packed down at the left side of the conveyance auger 31. For example, if the conveyance auger 31 is installed to the inside of the buffer chamber 24, the conveyance auger 31 further conveys the developer from the upstream side in the buffer chamber 24 filled with the developer, so that the developer is likely to be packed down in the buffer chamber 24. If the developer is packed down, the developer offers resistance to the rotation of the conveyance auger 31 which is disposed in the packed down developer, so that a driving force, that is, torque, required for the driving of the conveyance auger 31 is increased. In the worst case, the conveyance auger 31 cannot be rotated. That is, although the cleaner storage chamber 6 is in an almost full state, the developer is not sent to the detection chamber 28. As a result, the full state is not detected, and the cleaner storage chamber 6 is filled with the developer, so that the developer can overflow.

By contrast, according to the first example, the left end of the conveyance auger 31 is the free end, and does not reach the buffer chamber 24. Therefore, although the developer is packed down in the left direction of the conveyance auger 31, the resistance to the rotation of the conveyance auger 31 is decreased as compared with the case in which the conveyance auger 31 is installed to the inside of the buffer chamber 24, thereby reducing the possibility that the conveyance auger is not rotated.

Figure 15A:
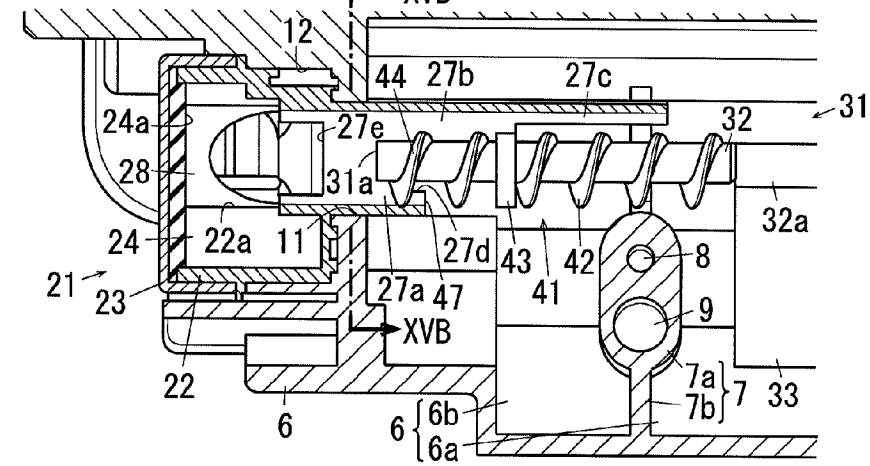
Figure 15B:
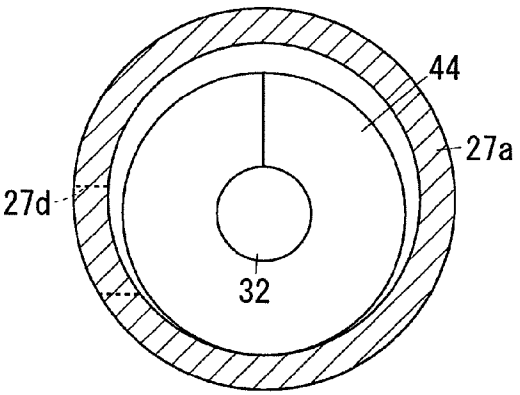
Figure 15C:
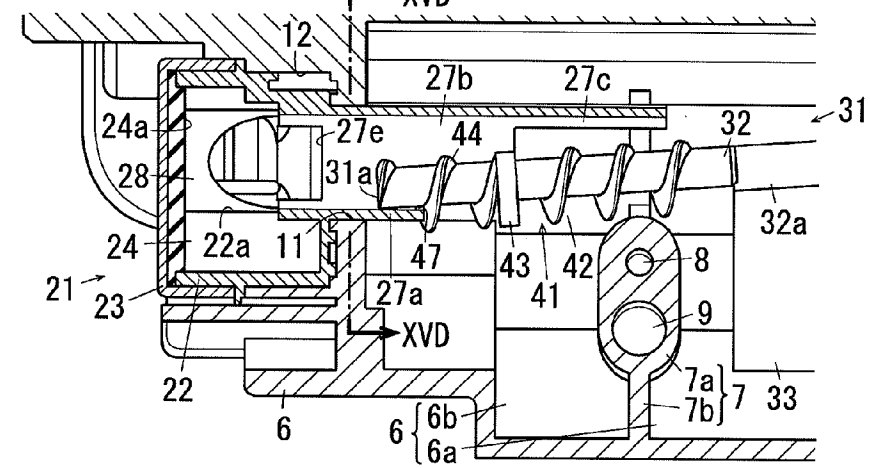
Figure 15D:
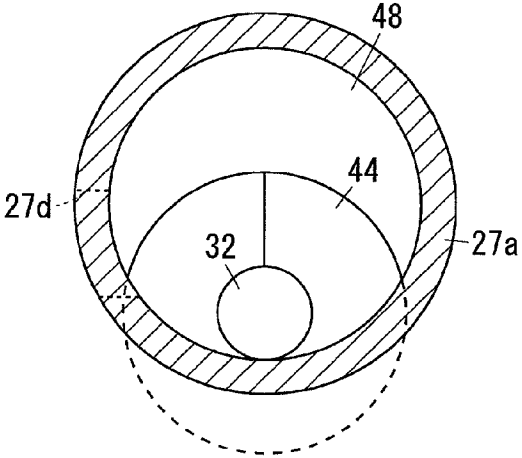

FIGS. 15A, 15B, 15C and 15D are explanatory views illustrating a state of the downstream end portion of the conveyance auger according to the first example, in which FIG. 15A is an explanatory view illustrating a state in which the outer peripheral surface of the spiral conveyance portion corresponding to FIG. 5 comes into contact with an inner peripheral surface of a third storage section, FIG. 15B is a cross-sectional view taken along the line XVB-XVB in FIG. 15A, FIG. 15C is an explanatory view illustrating a state in which the spiral conveyance portion is rotated from the state shown in FIG. 15A and then the shaft portion is slanted, and FIG. 15D is a cross-sectional view taken along the line XVD-XVD in FIG. 15C.

In FIGS. 15A, 15B, 15C and 15D, in the conveyance auger 31 according to the first example, which is supported in the cantilever state, the contact position between the outer peripheral surface of the spiral downstream conveyance portion 44 and the inner peripheral surface of the main guide portion 27*a* is changed in the left and right direction at the time of rotation. In the first example, since the length La, that is, the overlapping range of the downstream conveyance portion 44 and the main guide portion 27*a* is set to be less than 1 pitch of the downstream conveyance portion 44, while the conveyance auger 31 is rotated once, the state in which the outer peripheral surface of the downstream conveyance portion 44 is in contact with the inner peripheral surface of the main guide portion 27*a*, as shown in FIGS. 15A and 15B, and the state in which the outer peripheral surface of the downstream conveyance portion 44 is not in contact with the inner peripheral surface of the main guide portion 27*a*, as shown in FIGS. 15C and 15D, are repeated.

In the state shown in FIG. 15B, since the sectional area of the conveyance auger 31 is almost equal to the sectional area of the main guide portion 27*a*, the developer is effectively conveyed to the downstream side. As shown in FIGS. 15C and 15D, the left end 31*a* of the shaft portion 32 is slanted downwardly, so that a gap 48 is formed between the main guide portion 27*a* and the left end 31*a*. Accordingly, the developer is sufficiently pooled in the buffer chamber 24 at the downstream side of the conveyance auger 31, so that the developer is pressed and congealed. In the case where the density of the developer is excessive, the developer is likely to flow backward to the upstream side through the gap 48 as compared with the case in which the gap 48 is not formed. Therefore, as compared with the configuration in which the length La is set to be more than 1 pitch and the gap 48 is not formed, the gap 48 is periodically formed in the first example, so that the back flow is allowed to reduce excessive density of the developer at the downstream side of the conveyance auger 31. Therefore, it is possible to reduce concern of the torque of the conveyance auger 31 being excessively high or the rotation not being possible.

In addition, the inlet guide portion 27 according to the first example is provided with the first cutaway portion 27*d*. In the case where the developer flows back, the developer can move in the direction in which the developer is separated from the conveyance auger 31, that is, the developer is movable toward the inside the cleaner storage chamber 6 from the main guide portion 27*a*, through the first cutaway portion 27*d*. That is, the developer is allowed to flow in a return direction through the cutaway portions 27*d* and 27*e* with respect to the conveyance direction Ya of the conveyance auger 31, that is, to flow back. Accordingly, it is possible to prevent the internal pressure of the developer from being excessively increased in the buffer chamber 24.

In particular, according to the first example, in the cleaner storage chamber 6 provided with the first cutaway portion 27*d* at the rear side, and protruding rearward as shown in FIG. 6, it is possible to send the developer flowing backward to the rear side having a developer receiving margin larger than the front side. Accordingly, as compared with the case in which the cleaner storage chamber 6 is provided with the first cutaway portion 27*d* at the front side, it is possible to secure a sufficient space in which the developer flowing backward is deposited. Therefore, it is possible to suppress the occurrence of situations where the developer flowing backward is pressed and congealed.

Further, according to the first example, since the second cutaway portion 27*e* is disposed at the rear side, that is, the detection box 28 side, in the case where the amount of the developer is increased in the buffer chamber 24 and thus the resistance to the conveyance in the left direction is increased, it is possible to convey the developer in the rearward direction intersecting with the conveyance direction Ya through the second cutaway portion 27*e*. Accordingly, in the case where the flowability of the developer is remarkably decreased due to the environment or the like, even through the amount of the developer is increased in the buffer chamber 24 and thus the developer does not flow in the detection box 28, it is possible to send the developer to the detection box 28. Therefore, it is possible to detect the full state in the detection box 28.

In addition, according to the first example, it is possible to include the configuration of the cleaner storage chamber 6, the left conveyance portion 41 of the conveyance auger 31, the detection buffer member 21, and the detection box 28, and to intensively dispose the configuration of detecting the full state at one ends, that is, the left ends, of the photoreceptor cleaners LCy to CLk. Therefore, as compared with the conventional configuration which is not disposed at one end, it is possible to reduce the error detection of the full. Further, since the width (length of the widthwise direction) of the photoreceptor cleaners CLy to CLk is shortened, it contributes to the reduction in the dimensions of the photoreceptor units 1*y* to 1*k*, in particular, in the widthwise (length of the widthwise direction) direction. Accordingly, it is possible to densely mount the photoreceptor units 1*y* to 1*k*, that is, to dispose four photoreceptor units 1*y* to 1*k* within a close distance, thereby contributing to the miniaturization of the printer U, as compared with the case where the detection box or the like is disposed at the center portion.

Moreover, according to the first example, since the partition wall 7 is provided with the blade support portion 7*a* for supporting the cleaning blade 17, it is possible to reduce manufacturing costs, as compared with the case where it is separately installed. Further, since the space in which the members are disposed is reduced, so-called space savings are achieved, so that the cleaner storage chamber 6 can be used for higher capacity.

Modified Example

As described above, the example of the present invention has been described in detail. However, the present invention is not limited to the example mentioned above, and may be modified in various ways without departing from the technical spirit of the present invention described in claims. Modified examples (H01) to (H013) of the present invention will be described below.

(H01) In the example mentioned above, the printer U is employed as an example of the image forming apparatus, but the present invention is not limited thereto. For example, the present invention may be applied to a FAX, a copying machine, or a multifunction peripheral having all functions of those or plural functions. In addition, the present invention is not limited to a full-color image forming apparatus. The invention may be applied to an image forming apparatus having a single color, that is, a so-called monochrome image forming apparatus.

(H02) In the example mentioned above, the reflection-type optical sensor is used to detect the full, but the present invention is not limited thereto. Depending upon the design or specifications, a transmission-type optical sensor may be used, or a sensor other than light, or a detection member known in the art, such as a sensor using magnetism, may be used.

(H03) In the example mentioned above, the configuration, in which the left conveyance portion 41 is provided with the leveling portion 43 to reduce the conveyance speed, is illustrative, but the present invention is not limited thereto. A configuration in which the leveling portion 43 is not provided, that is, a configuration in which only the shaft portion 32 is interposed between the upstream conveyance portion 42 and the downstream conveyance portion 44 which are formed in the spiral shape to reduce the conveyance speed, is possible. In addition, a configuration in which the spiral is formed almost vertically to the axial direction of the shaft portion 32, in comparison with the upstream conveyance portion 42 or the downstream conveyance portion 44 to reduce the conveyance speed, in which the spiral is reversely wound to reduce the conveyance speed, or in which the outer diameter of the spiral is reduced or the axial diameter of the shaft portion 32 is increased to reduce the conveyance speed, is possible. Accordingly, it is possible to reduce the conveyance speed by conveying the developer in the same conveyance direction at lower conveyance speed, or in a direction reverse to the conveyance direction Ya, that is, at a negative conveyance speed.

(H04) In the example mentioned above, the configuration, in which the leveling is performed by the leveling portion 43 formed in the shape of disk vertical to the axial direction of the shaft portion 32, is illustrative, but the present invention is not limited thereto. A configuration, in which the leveling is performed by a plate-shaped member extending in an axial direction, a so-called paddle, is possible.

(H05) In the example mentioned above, the configuration, in which the conveyance auger 31 is provided with the conveyance film 33 formed with the slit portion 33*a*, is illustrative, but the present invention is not limited thereto. A configuration, in which the conveyance film 33 is omitted, or the leveling member such as paddle is disposed, instead of the conveyance film 33, is possible. In addition, it is desirable to install the slit portion 33*a*, but the slit portion may be omitted.

(H06) In the example mentioned above, it is desirable to install the detection buffer member 21, but the detection buffer member may be omitted. A configuration capable of directly feeding the developer to the detection box 28 from the downstream chamber 6*b* is possible.

(H07) In the example mentioned above, the configuration, in which the height of the outlet port 22*a* is set to be equal to the height of the inlet guide 27 in the buffer chamber 24, is illustrative, but the present invention is not limited thereto. A configuration, in which the outlet portion 22*a* is set to be higher than the inlet guide 27 so that the deposited developer flows in the detection chamber 28*a* from the bottom of the buffer chamber 24, is possible. In this instance, it is desirable that the height of the outlet port 22*a* is equal to or higher than the height of the inlet guide 27, but the height of the outlet port 22*a* may be set to be lower that the height of the inlet guide 27.

(H08) In the example mentioned above, it is desirable to support the conveyance auger 31 in a cantilever state, but the conveyance auger may be supported on both sides. In this instance, it is particularly desirable to employ measures for high torque, for example, a high-output driving source is used, or the volume of the buffer chamber 24 is sufficiently secured.

(H08) In the example mentioned above, it is desirable that the length La is set to be less than 1 pitch, but it is possible to set the length La equal to or more than 1 pitch. That is, it is desirable that the shaft portion 32 has a periodically slanted configuration, but the shaft portion 32 can have a configuration in which it cannot be slanted. In this instance, in order to allow the back flow, the present invention can be modified, that is, the sectional area of the upper portion of the main guide portion 27*a* is increased to always form the gap between the downstream conveyance portion 44 and the main guide portion 27*a*, or the size of the first cutaway portion 27*d* is increased.

(H09) In the example mentioned above, it is desirable to partition the upstream chamber 6*a* and the downstream chamber 6*b* by the partition wall 7, but the shape or the position of the partition wall 7 can be optionally altered, or the partition wall 7 can be omitted. In addition, it is desirable to use the partition wall 7 and the blade support portion 7*a* in common, but a configuration which does not use them in common is possible. In addition, by positioning the partition wall 7 in the image region L1, it is possible to shorten the length of the cleaner container 3 in the left and right direction, but the present invention is not limited thereto. It is possible to dispose the partition wall at the outside of the image region L1. That is, it is possible to dispose the partition wall 7 at the outside of the image region L1, and dispose the downstream chamber 6*b* at further outside of the partition wall 7. In this instance, since the downstream chamber 6*b* is also disposed externally to the outside of the image region L1, as well as the partition wall 7, it is possible to structurally suppress the developer which is removed by the cleaning blade 17 from dropping into the blade support portion 7*a* or the downstream chamber 6*b*. Further, it is possible to suppress the dropped developer from leaking outward, so that the cover portions 27*b* and 27*c* can be omitted.

(H010) In the example mentioned above, it is desirable to install the cover portions 27*b* and 27*c* corresponding to the partition wall 7 or the downstream chamber 6*b* which is disposed in the image region L1, but the cover portions can be omitted. In addition, the cover portions 27*b* and 27*c* are illustrated in a partially cylindrical shape, but the present invention is not limited thereto. Any shape, such as a roof shape of gable roof or shed roof, an umbrella shape, or a partial polygonal shape or the like, can be used.

(H011) In the example mentioned above, it is desirable to provide the inlet guide 27 with the cutaway portions 27*d* and 27*e*, but they may be omitted. In addition, the position, shape, or dimension of the cutaway portions 27*d* and 27*e* can be arbitrarily altered depending upon the design. In this instance, the configuration provided with the inlet guide portion 27 is illustrative, but a configuration in which the developer flows in the buffer chamber 24 through the inlet guide portion 27 is omitted, and a configuration in which the developer directly flows in the buffer chamber 24 from the cleaner storage chamber 6 is possible.

(H012) In the example mentioned above, the photoreceptor cleaners CLy to CLk are illustrated as one example of the storage container for the developer, but the present invention is not limited thereto. It can be applied to a storage container for a developer in which the collected developer is stored and it is required to detect the full state. For example, in a configuration in which the developer is not collected in the photoreceptor cleaners CLy to CLk, and is conveyed to a separate container, that is, a so-called waste toner box, the configuration according to the first example can be applied to the waste toner box.

(H013) In the example mentioned above, the length of the conveyance auger 31 in the axial direction is limited to the illustrative length, but the present invention is not limited thereto. The position of the left end 31*a* with respect to the inlet guide 27 can be altered depending upon the design or specification, for example, the left end can be extended in the left direction to the extent that it is able to deal with the torque which is increased accompanying the overload of the developer, the left end 31*a* may penetrate through the inlet guide 27 in the left direction or the like.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A storage container for a developer, comprising:

a first storage unit in which a collected developer is stored;

a second storage unit which is disposed at an end of one end side of the first storage unit, in which the developer conveyed from the first storage unit is stored;

a detection member which detects the developer stored in the second storage unit;

a full-state determining unit which determines whether the first storage unit is a full state or not, based on a detected result of the detection member; and a conveyance member which is disposed in the first storage unit, and is rotated to convey the developer stored in the first storage unit to the second storage unit, wherein one end side of the conveyance member is supported on other end side of the first storage unit in a cantilever state, and other end side of the conveyance member is disposed to have a gap with respect to a wall of one end side of the second storage unit.

2. The storage container for the developer as claimed in claim 1, further comprising a third storage unit of a hollow cylindrical shape which is disposed at the one end side of the first storage unit, supports the other end side of the conveyance member in the third storage unit, and is configured such that the developer conveyed by the conveyance member is moved in the third storage unit.

3. The storage container for the developer as claimed in claim 2, further comprising an outlet portion which is formed at an upstream side of the third storage unit with respect to a conveyance direction of the developer by the conveyance member, and is capable of discharging the developer from the third storage unit toward the first storage unit.

4. An image forming apparatus comprising:

an image retainer having a surface on which a latent image is formed;

a developing unit which develops the latent image formed on the surface of the image retainer to a visible image;

a transfer unit which transfers the visible image formed on the surface of the image retainer to a medium; and the storage container as claimed in claim 2, which stores a developer removed from the surface of the image retainer from which the visible image is transferred.

5. The storage container for the developer as claimed in claim 3, wherein the conveyance member has a spiral conveyance portion for conveying the developer during rotation, and the conveyance member is set such that a length of a region which is overlapped with a lower end surface of the third storage unit in an axial direction is shorter than a pitch of the spiral conveyance portion.

6. An image forming apparatus comprising:

an image retainer having a surface on which a latent image is formed;

a developing unit which develops the latent image formed on the surface of the image retainer to a visible image;

a transfer unit which transfers the visible image formed on the surface of the image retainer to a medium; and the storage container as claimed in claim 3, which stores a developer removed from the surface of the image retainer from which the visible image is transferred.

7. An image forming apparatus comprising:

an image retainer having a surface on which a latent image is formed;

a developing unit which develops the latent image formed on the surface of the image retainer to a visible image;

a transfer unit which transfers the visible image formed on the surface of the image retainer to a medium; and the storage container as claimed in claim 5, which stores a developer removed from the surface of the image retainer from which the visible image is transferred.

8. An image forming apparatus comprising:

an image retainer having a surface on which a latent image is formed;

a developing unit which develops the latent image formed on the surface of the image retainer to a visible image;

a transfer unit which transfers the visible image formed on the surface of the image retainer to a medium; and the storage container as claimed in claim 1, which stores a developer removed from the surface of the image retainer from which the visible image is transferred.

* * * * *